US007857664B2

(12) United States Patent
Waryck et al.

(10) Patent No.: US 7,857,664 B2
(45) Date of Patent: Dec. 28, 2010

(54) QUICK CONNECT/DISCONNECT CABLE APPARATUS FOR COMPUTER PERIPHERALS

(75) Inventors: James Waryck, Redondo Beach, CA (US); Victor G. Paz, Sierra Madre, CA (US)

(73) Assignee: QC Technologies, Pasadena, CA (US)

( * ) Notice: Subject to any disclaimer, the term of this patent is extended or adjusted under 35 U.S.C. 154(b) by 110 days.

(21) Appl. No.: 12/015,400

(22) Filed: Jan. 16, 2008

(65) Prior Publication Data

US 2008/0212275 A1 Sep. 4, 2008

Related U.S. Application Data

(60) Provisional application No. 60/892,811, filed on Mar. 2, 2007.

(51) Int. Cl.
*H01R 25/001* (2006.01)

(52) U.S. Cl. ..... 439/638

(58) Field of Classification Search ..... 439/638, 439/367, 131, 654; 361/724, 788, 727
See application file for complete search history.

(56) References Cited

U.S. PATENT DOCUMENTS 4,361,375 A * 11/1982 Bailey et al. ..... 439/357
4,449,778 A * 5/1984 Lane ..... 439/607.47
4,747,785 A * 5/1988 Roberts et al. ..... 439/88
5,411,416 A * 5/1995 Balon et al. ..... 439/639
5,505,637 A * 4/1996 Kramer et al. ..... 439/607.48
5,567,180 A 10/1996 Seo
5,569,052 A 10/1996 Belt et al.
5,637,417 A * 6/1997 Engmark et al. ..... 429/97
5,675,813 A 10/1997 Holmdahl
5,923,757 A 7/1999 Hocker et al.
5,931,929 A * 8/1999 Tran et al. ..... 710/69
6,000,042 A 12/1999 Henrie
6,093,038 A 7/2000 Chen et al.
6,102,745 A 8/2000 Schultz et al.
6,128,743 A 10/2000 Rothenbaum
6,238,246 B1 * 5/2001 Ferrill et al. ..... 439/607.47

(Continued)

FOREIGN PATENT DOCUMENTS

JP 6-111884 4/1994

(Continued)

OTHER PUBLICATIONS

International Search Report for International Application No. PCT/US08/55530, dated Jul. 30, 2008.

*Primary Examiner*—Chandrika Prasad
(74) *Attorney, Agent, or Firm*—Arent Fox LLP

(57) ABSTRACT

A quick connect/disconnect cable apparatus is provided having a housing with a first housing component and a second housing component. The first housing component is separable from the second housing component at an interface. The first housing component has first connecting parts at the interface. The second housing component has corresponding mating second connecting parts at the interface. The first housing component further includes a plurality of ports located on at least one first housing component surface. The plurality of ports are adapted to allow a plurality of peripheral computer devices to connect to the plurality of ports. The second housing component further includes means for allowing one or more cables to connect between the second housing component and a computer.

28 Claims, 22 Drawing Sheets

U.S. PATENT DOCUMENTS

| | | | | |
|---|---|---|---|---|
| 6,297,963 | B1 * | 10/2001 | Fogle | 361/747 |
| 6,321,340 | B1 | 11/2001 | Shin et al. | |
| 6,483,709 | B1 | 11/2002 | Layton | |
| 6,522,532 | B2 * | 2/2003 | Liao et al. | 361/679.43 |
| 6,558,201 | B1 | 5/2003 | Begley et al. | |
| 6,622,178 | B1 | 9/2003 | Burke et al. | |
| 6,697,892 | B1 * | 2/2004 | Laity et al. | 710/72 |
| 6,767,253 | B1 * | 7/2004 | Werner et al. | 439/638 |
| 6,934,788 | B2 | 8/2005 | Laity et al. | |
| 6,943,527 | B2 * | 9/2005 | Liu et al. | 320/107 |
| 6,966,791 | B1 | 11/2005 | Farr | |
| 7,484,963 | B2 * | 2/2009 | Fenwick et al. | 439/1 |
| 2003/0032335 | A1 * | 2/2003 | Garnett et al. | 439/638 |
| 2003/0167369 | A1 | 9/2003 | Chen et al. | |
| 2005/0033890 | A1 | 2/2005 | Lee | |
| 2005/0177669 | A1 | 8/2005 | Peters et al. | |
| 2005/0246470 | A1 | 11/2005 | Brenner | |
| 2006/0085584 | A1 | 4/2006 | Chen et al. | |
| 2008/0305693 | A1 * | 12/2008 | Mei et al. | 439/701 |

FOREIGN PATENT DOCUMENTS

| | | |
|---|---|---|
| JP | 11-53305 | 2/1999 |
| KR | 2003-0017400 | 3/2003 |
| KR | 2003-0017446 | 3/2003 |

* cited by examiner

QUICK CONNECT/DISCONNECT CABLE APPARATUS FOR COMPUTER PERIPHERALS

CROSS-REFERENCE TO RELATED APPLICATION(S)

This patent application claims priority to Provisional Patent Application 60/892,811 entitled "QUICK CONNECT/DISCONNECT CABLE SYSTEM FOR COMPUTER PERIPHERALS" and filed on Mar. 2, 2007, the entire content of which is incorporated herein by reference.

BACKGROUND OF THE INVENTION

1. Field of the Invention

The present invention relates generally to a cable management apparatus, and more particularly, to a cable management apparatus for computer peripherals having an interface for connecting and disconnecting the computer peripherals.

2. Description of Related Art

Cable manager apparatuses are generally known in the art. For example, U.S. Pat. No. 5,567,180, which is herein incorporated by reference, provides a cable manager apparatus unifying ports of peripheral equipment. Such cable manager apparatuses do not provide an ability to easily connect/disconnect a computer from the computer peripheral devices. In such prior art apparatuses, each of the respective cables for each of the peripheral devices must at least be disconnected from the back of the computer or from the cable manager apparatus itself.

Accordingly, there is a need for a cable manager apparatus that provides an ability to easily connect a computer to and easily disconnect a computer from peripheral devices. Such a cable manager apparatus with an easy connect/disconnect would be useful for computer owners who are unfamiliar with cable port types and who have to disconnect the cables to their computer in order to bring their computer in for service, to clean around or underneath the computer, or for some other reason.

SUMMARY OF THE INVENTION

A quick connect/disconnect cable apparatus is provided having a housing with a first housing component and a second housing component. The first housing component is separable from the second housing component at an interface. The first housing component has first connecting parts at the interface. The second housing component has corresponding mating second connecting parts at the interface. The first housing component further includes a plurality of ports located on at least one first housing component surface. The plurality of ports are adapted to allow a plurality of peripheral computer devices to connect to the plurality of ports. The second housing component further includes means for allowing one or more cables to connect between the second housing component and a computer.

In an exemplary embodiment of the present invention, the first connecting parts include at least one of male metal leads or female metal lead holes, and the second connecting parts include corresponding mating male metal leads and/or female metal lead holes, with the male metal leads being adapted to insert into the female metal lead holes.

In an exemplary embodiment of the present invention, the first connecting parts include at least one of a card connector or a card connector slot, and the second connecting parts include a corresponding mating card connector or card connector slot, with the card connector adapted to insert into the card connector slot.

In an exemplary embodiment of the present invention, the plurality of ports include at least one of a mini audio jack, a large audio jack, a type A Universal Serial Bus port, a PS/2 keyboard port, a Registered Jack-11, an Ethernet port, a type B Universal Serial Bus port, a 4-pin FireWire, a 6-pin FireWire, a VGA connector port, an S-Video port, a Digital Video Interface port, a serial port, or a parallel port.

In an exemplary embodiment of the present invention, the first housing component or the second housing component includes a wireless receiver and transmitter for communicating with at least one wireless periphery device.

In an exemplary embodiment of the present invention, the first housing component further includes a receiver/transmitter window.

In an exemplary embodiment of the present invention, the first housing component further includes internal housing ports locating within the housing adjacent the receiver/transmitter window.

In an exemplary embodiment of the present invention, the first housing component or second housing component includes a latching means for securing the first housing component and the second housing component together.

In an exemplary embodiment of the present invention, the first housing component includes a power connection port.

In an exemplary embodiment of the present invention, the second housing component includes a power connection port.

In an exemplary embodiment of the present invention, the second housing component is adapted to be mounted to a table, a floor, or a wall.

In an exemplary embodiment of the present invention, the one or more cables are housed in a single shielded cable.

In an exemplary embodiment of the present invention, a computer peripheral connector is attached to the one or more cables and to the shielded cable. The computer peripheral connector is adapted to connect to a peripheral computer port of the computer.

In an exemplary embodiment of the present invention, the computer peripheral connector includes a plurality of male leads, female port holes, or both, for connecting to the peripheral computer port, and further includes an indentation or protrusion for aiding in aligning the computer peripheral connector for attachment to the peripheral computer port, the peripheral computer port having a corresponding indentation or protrusion.

In an exemplary embodiment of the present invention, the computer peripheral connector is securable to the peripheral computer port.

In an exemplary embodiment of the present invention, the computer peripheral connector includes a card connector or a card connector slot for connecting to the peripheral computer port.

A quick connect/disconnect cable apparatus is provided having a housing with a first housing component and a second housing component. The first housing component is separable from the second housing component at an interface. The first housing component has first connecting parts on a first housing component surface of the interface. The second housing component has corresponding mating second connecting parts on a second housing component surface of the interface. The first housing component further includes a plurality of ports located on at least one first housing component surface. The plurality of ports are adapted to allow a plurality of peripheral computer devices to connect to the plurality of ports. The second housing component is a computer system. The computer system has a peripheral computer port for allowing the first housing component to attach. The peripheral computer port is said second housing component surface.

In an exemplary embodiment of the present invention, the first housing component is securable to the peripheral computer port.

A peripheral port connector device is providing having a body, a plurality of ports on a first side of the body, and a computer port connector on a second side of the body. The computer port connector has a plurality of male leads and/or female port holes, or a card connector and/or card connector slot. The computer port connector is adapted to connect to a peripheral computer port of a computer. The peripheral computer port has a corresponding plurality of male leads and/or female port holes or a corresponding card connector and/or card connector slot for allowing the computer port connector to attach.

In an exemplary embodiment of the present invention, the peripheral computer port provides data connections for all peripheral devices to connect to the computer.

DETAILED DESCRIPTION

Figure 1:
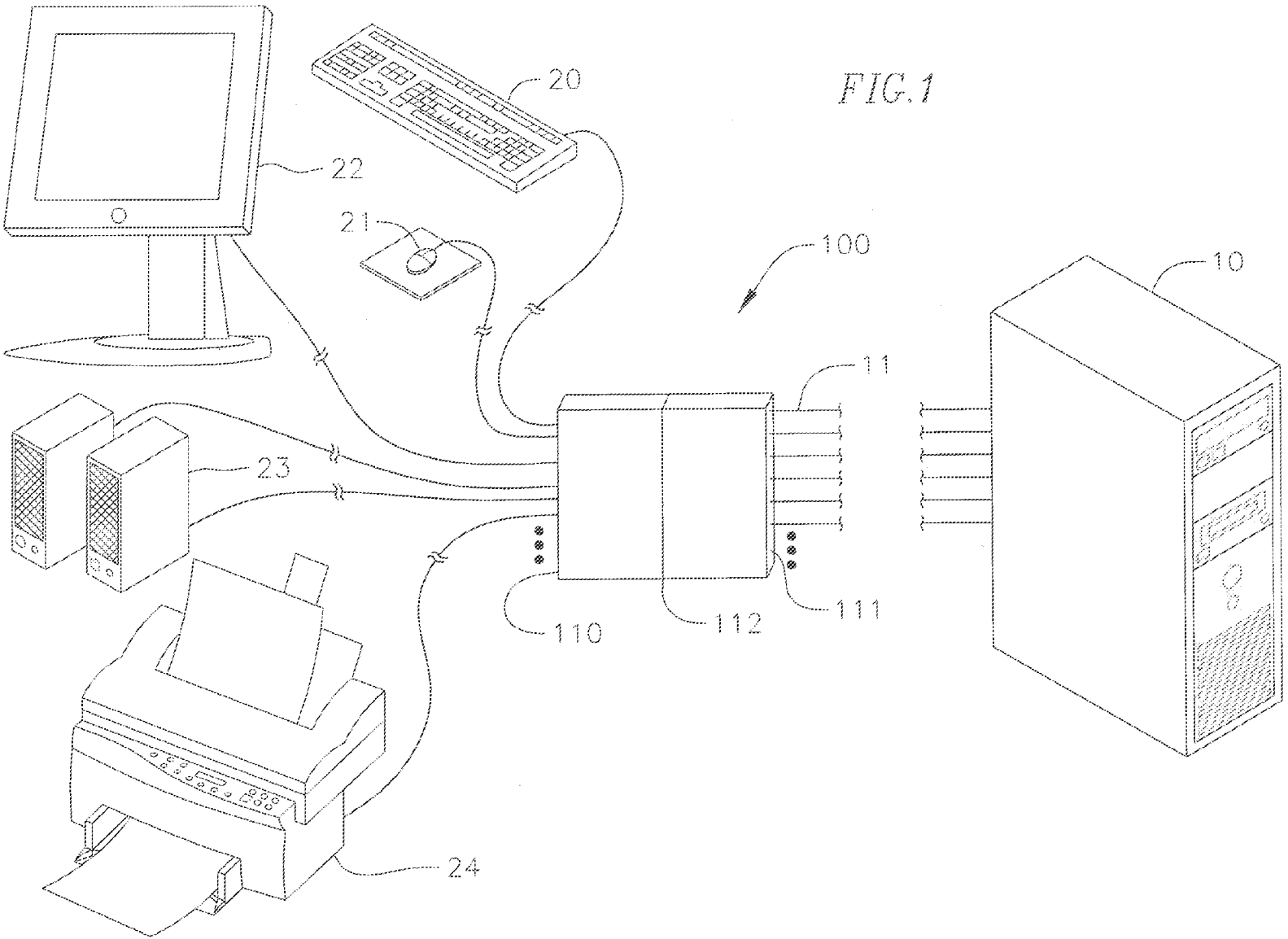
FIG. 1 is a perspective view showing how the quick connect/disconnect cable apparatus connects with a computer and computer peripherals according to an exemplary embodiment of the present invention.

FIG. 1 is a perspective view showing how a quick connect/disconnect cable apparatus 100 connects with a computer 10 and computer peripherals 20, 21, 22, 23, 24 according to an exemplary embodiment of the present invention. The quick connect/disconnect cable apparatus 100 allows a plurality of computer peripherals 20, 21, 22, 23, 24 to connect to a front end 110 of the quick connect/disconnect cable apparatus 100 and allows corresponding port connector cables 11 connected to a computer 10 to connect to a rear end 111 of the quick connect/disconnect cable apparatus 100. The quick connect/disconnect cable apparatus 100 also includes connect/disconnect interface 112 in a center portion for allowing the computer 10 to be easily disconnected from or connected to the computer peripherals 20, 21, 22, 23, 24. That is, the quick connect/disconnect cable apparatus 100 provides an interface 112 that allows the computer 10 to be easily disconnected from and easily reconnected to the computer peripherals 20, 21, 22, 23, 24.

Although FIG. 1 shows only a keyboard 20, a mouse 21, a monitor 22, speakers 23, and a printer 24 as computer peripherals, all computer peripherals that can connect directly to a computer may connect to the quick connect/disconnect cable apparatus 100.

Figure 2:
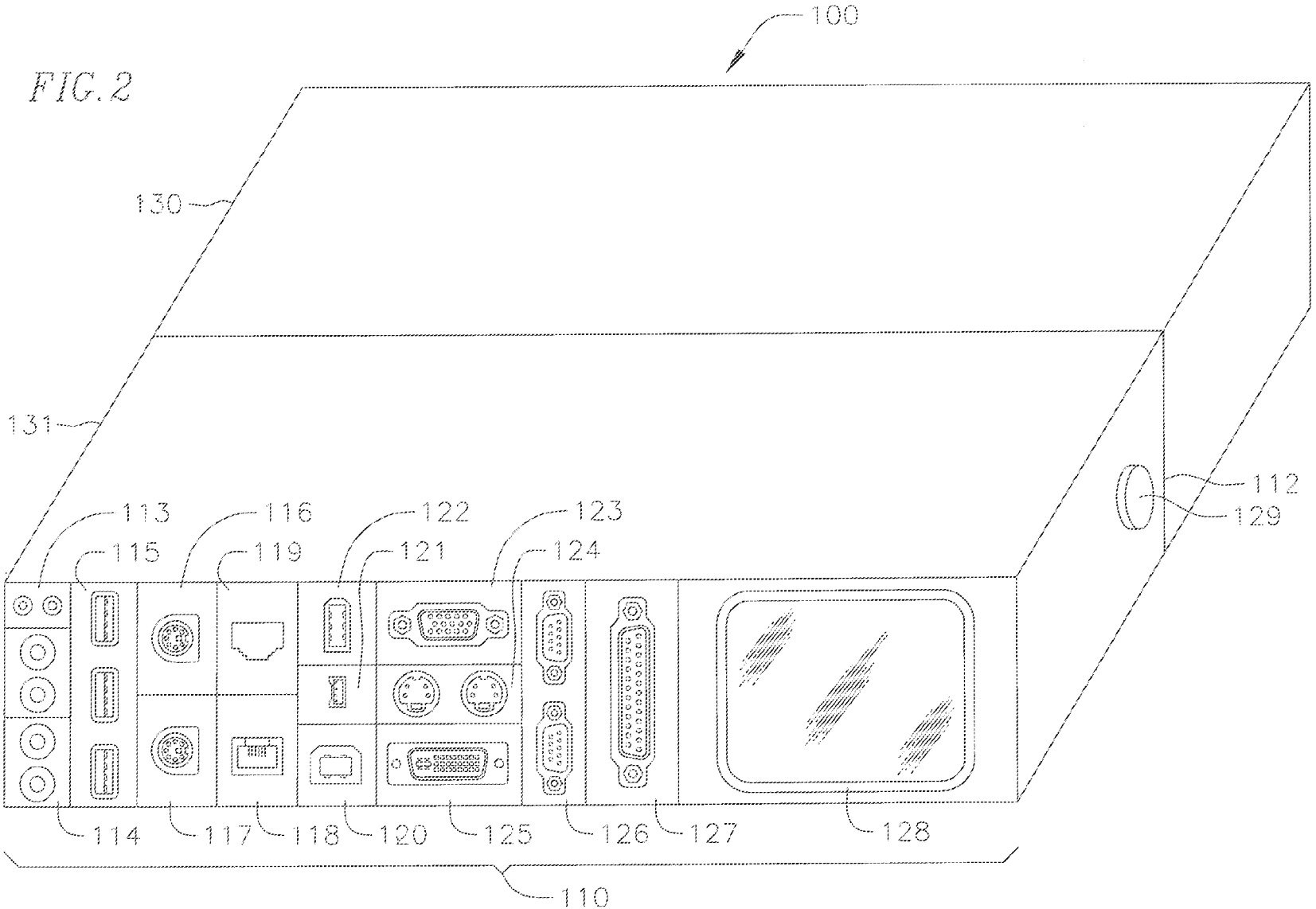
FIG. 2 is a perspective view of the quick connect/disconnect cable apparatus according to an exemplary embodiment of the present invention.

FIG. 2 is a perspective view of the quick connect/disconnect cable apparatus 100 according to an exemplary embodiment of the present invention. The quick connect/disconnect cable apparatus 100 includes a plurality of computer peripheral ports for allowing a plurality of computer peripherals to connect to a front end 110 of the quick connect/disconnect cable apparatus 100. Such plurality of computer peripheral ports may include any type of computer peripheral ports, including mini audio jacks 113, larger audio jacks 114, type A Universal Serial Bus ("USB") ports 115, PS/2 keyboard port 116, PS/2 mouse port 117, Registered Jack-11 (RJ-11) 118 for connecting telephone equipment, Ethernet port 119 (such as RJ45 Ethernet port), type B USB port 120, 4-pin FireWire 121, 6-pin FireWire 122, VGA connector port 123, S-Video ports 124, Digital Video Interface ("DVI") port 125, serial ports 126, and parallel port 127. FireWire is proprietary name of Apple Computer for the IEEE 1394 interface.

The quick connect/disconnect cable apparatus 100 may further include receiver/transmitter window 128 for allowing wireless peripherals to be used. In such an embodiment, the quick connect/disconnect cable apparatus 100 may include receiver/transmitter hardware for communicating with wireless devices, or alternatively, may include connection ports, such as USB ports, for allowing wireless transmitter/receiver devices paired with particular computer peripheral devices to be connected internally to the quick connect/disconnect cable apparatus 100.

The quick connect/disconnect cable apparatus 100 further includes buttons 129 located on the sides of the quick connect/disconnect cable apparatus 100. The buttons 129 when pressed may release a latching mechanism internal to the quick connect/disconnect cable apparatus 100, thus allowing a front half 131 of the quick connect/disconnect cable apparatus 100 to be disconnected from a rear half 130 of the quick connect/disconnect cable apparatus 100 at connect/disconnect interface 112.

Figure 3:
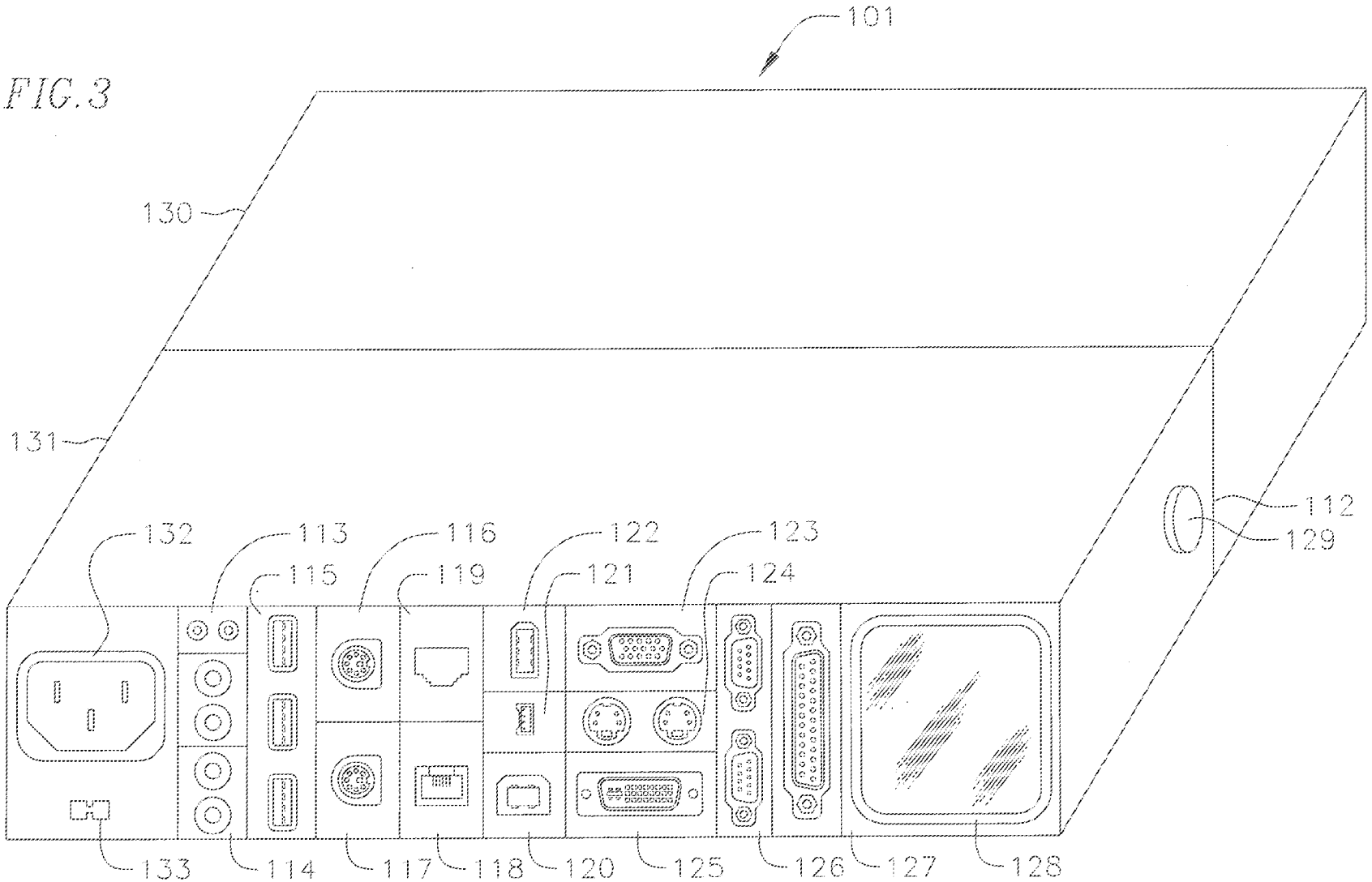
FIG. 3 is a perspective view of a quick connect/disconnect cable apparatus according to another exemplary embodiment of the present invention.

FIG. 3 is a perspective view of a quick connect/disconnect cable apparatus 101 according to another exemplary embodiment of the present invention. The quick connect/disconnect cable apparatus 101 may further include power connection port 132 and corresponding circuit breaker reset 133 that trips when excessive power is consumed. The power connection port 132 allows for a power cord to be connected to a front end of the quick connect/disconnect cable apparatus 101. The power supplied to power connection port 132 provides power to computer 10 and to any hardware included in the quick connect/disconnect cable apparatus 101 to handle wireless peripherals. Because the quick connect/disconnect cable apparatus 101 may disconnect at connect/disconnect interface 112, and may thus expose power leads to a user of the quick connect/disconnect cable apparatus 101, the quick connect/disconnect cable apparatus may be adapted such that only hot female metal lead holes are exposed (as opposed to male metal leads) when the quick connect/disconnect cable apparatus 101 is separated at connect/disconnect interface 112.

Figure 4:
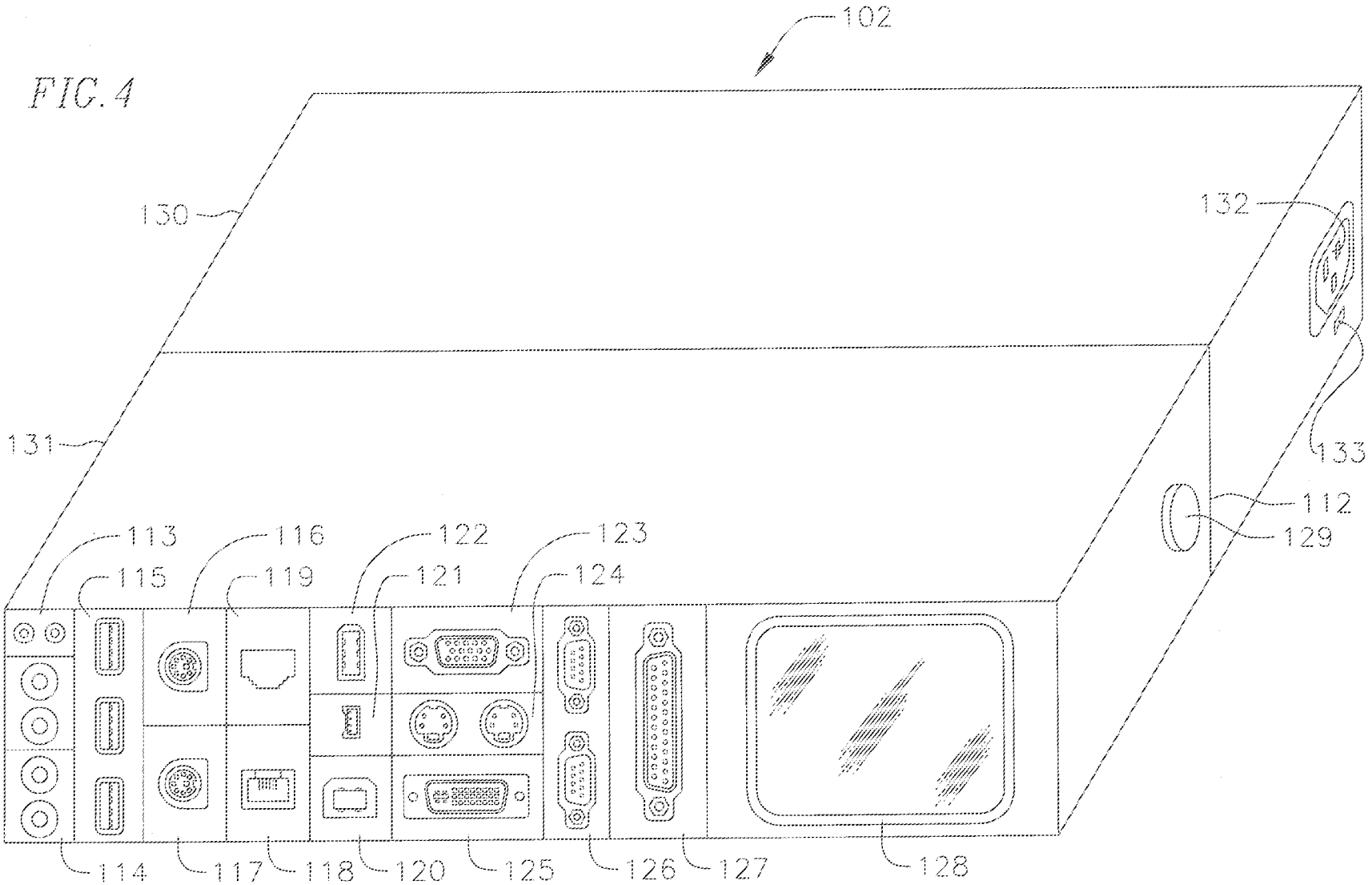
FIG. 4 is a perspective view of a quick connect/disconnect cable apparatus according to yet another exemplary embodiment of the present invention.

FIG. 4 is a perspective view of a quick connect/disconnect cable apparatus 102 according to yet another exemplary embodiment of the present invention. If the quick connect/disconnect cable apparatus 102 does not provide dedicated hardware for handling wireless devices, but instead provides ports for connecting corresponding communication devices for the wireless peripherals, the quick connect/disconnect cable apparatus 102 may alternatively provide the power connection port 132 and corresponding circuit breaker reset 133 in a rear portion 130 of the quick connect/disconnect cable apparatus 102, thus eliminating the need to feed the power provided to the power connection port 132 through the connect/disconnect interface 112.

Figure 5:
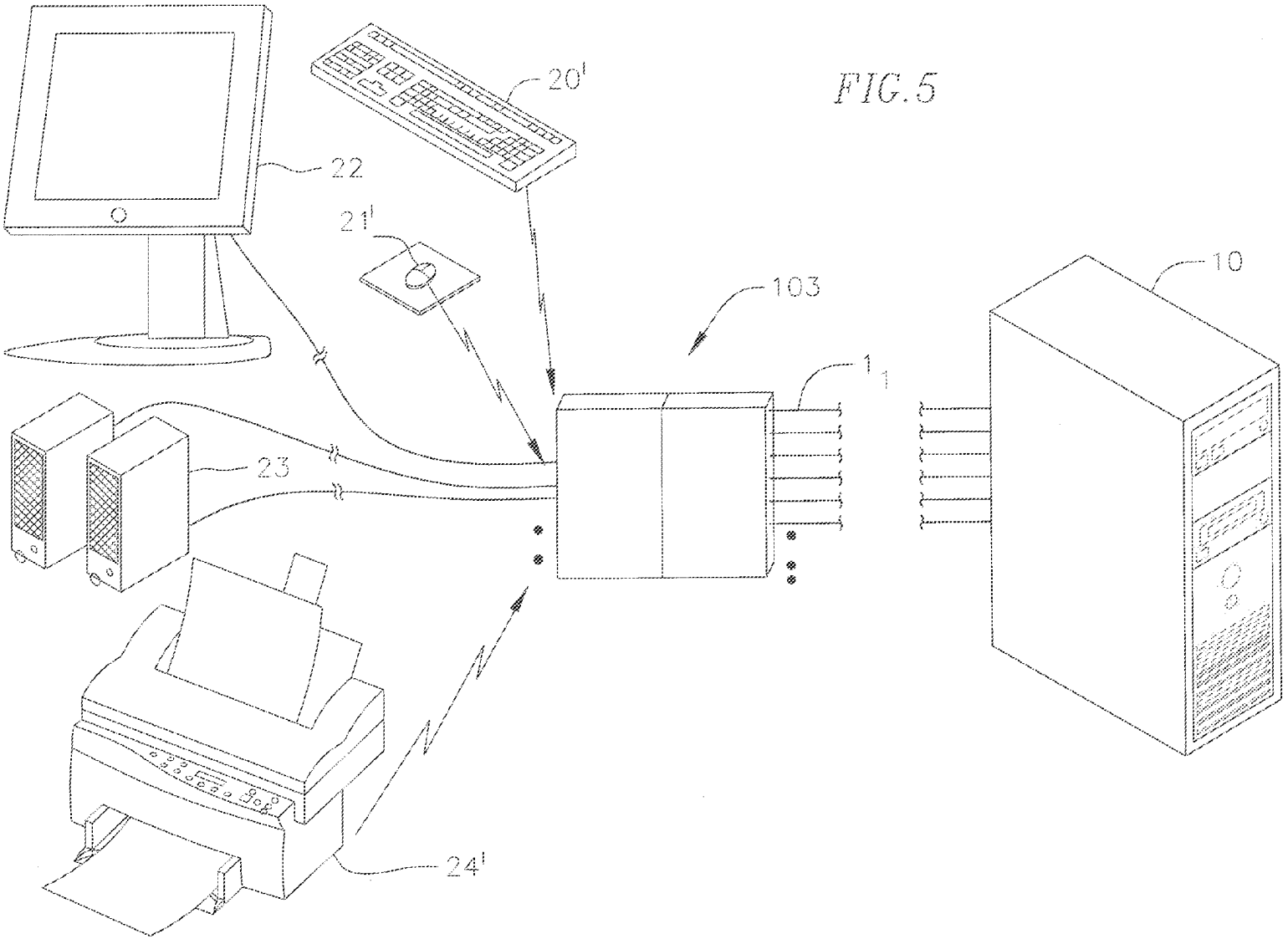
FIG. 5 is a perspective view showing wireless peripheral devices used in conjunction with the quick connect/disconnect cable apparatus according to an exemplary embodiment of the present invention.

FIG. 5 is a perspective view showing wireless peripheral devices used in conjunction with a quick connect/disconnect cable apparatus 103 according to an exemplary embodiment of the present invention. As depicted in FIG. 5, the quick connect/disconnect cable apparatus 103 may receive wireless signals from one or more wireless peripheral devices at receiver/transmitter window 127 for allowing wireless devices 20', 21', 24' to communicate with corresponding receiver/transmitter devices to which the wireless peripheral devices are paired.

Figure 6:
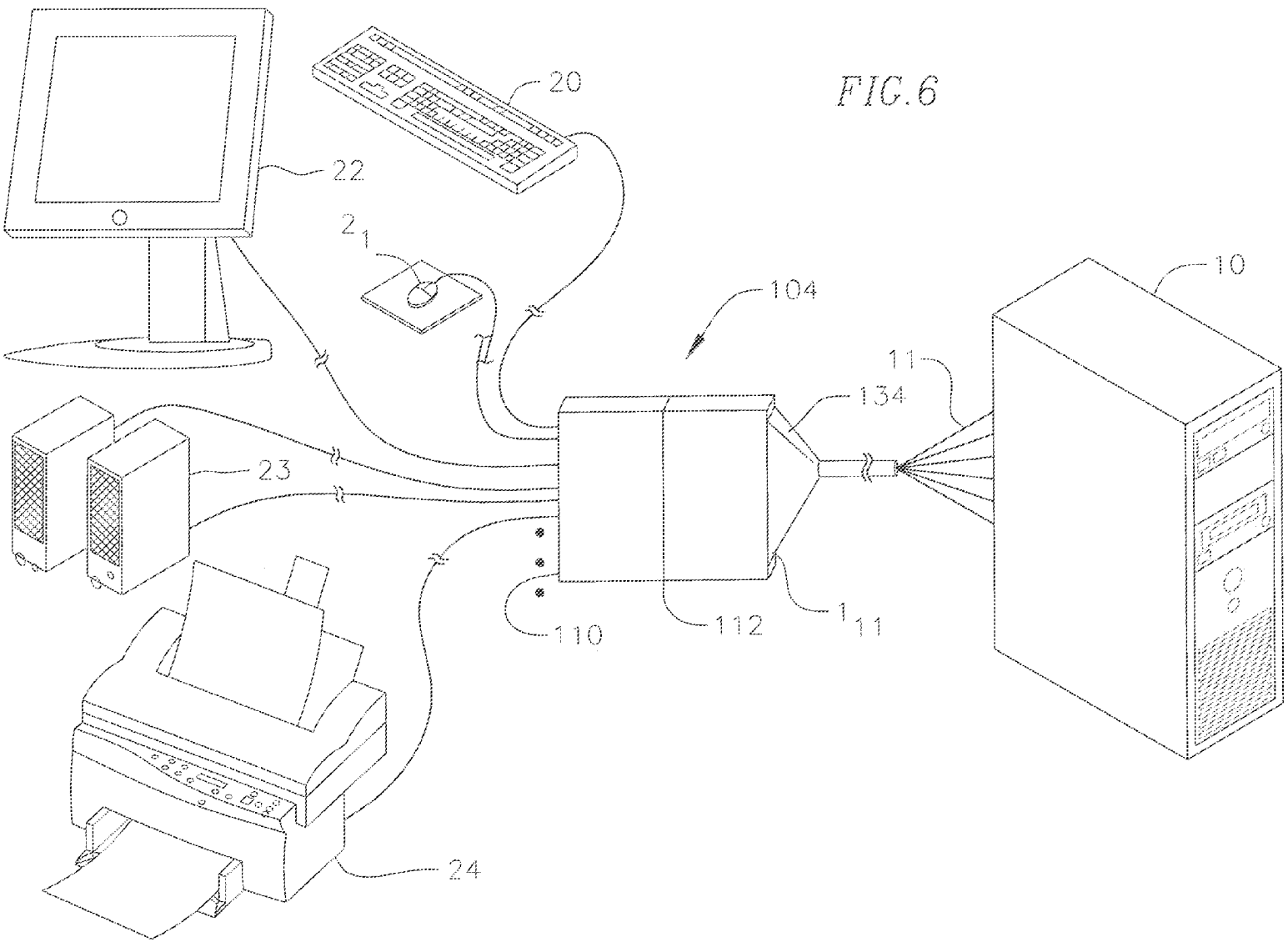
FIG. 6 is a perspective view showing an additional shielding member of the quick connect/disconnect cable apparatus according to an exemplary embodiment of the present invention.

FIG. 6 is a perspective view showing an additional shielding member 134 of a quick connect/disconnect cable apparatus 104 according to an exemplary embodiment of the present invention. The quick connect/disconnect cable apparatus 104 may further include a shielding member 134 enclosing the connection ports located on a rear end 111 of the quick connect/disconnect cable apparatus 104. Such a shielding member 134 prevents the port connector cables 11 from being accidentally pulled out of a respective port.

Figure 7:
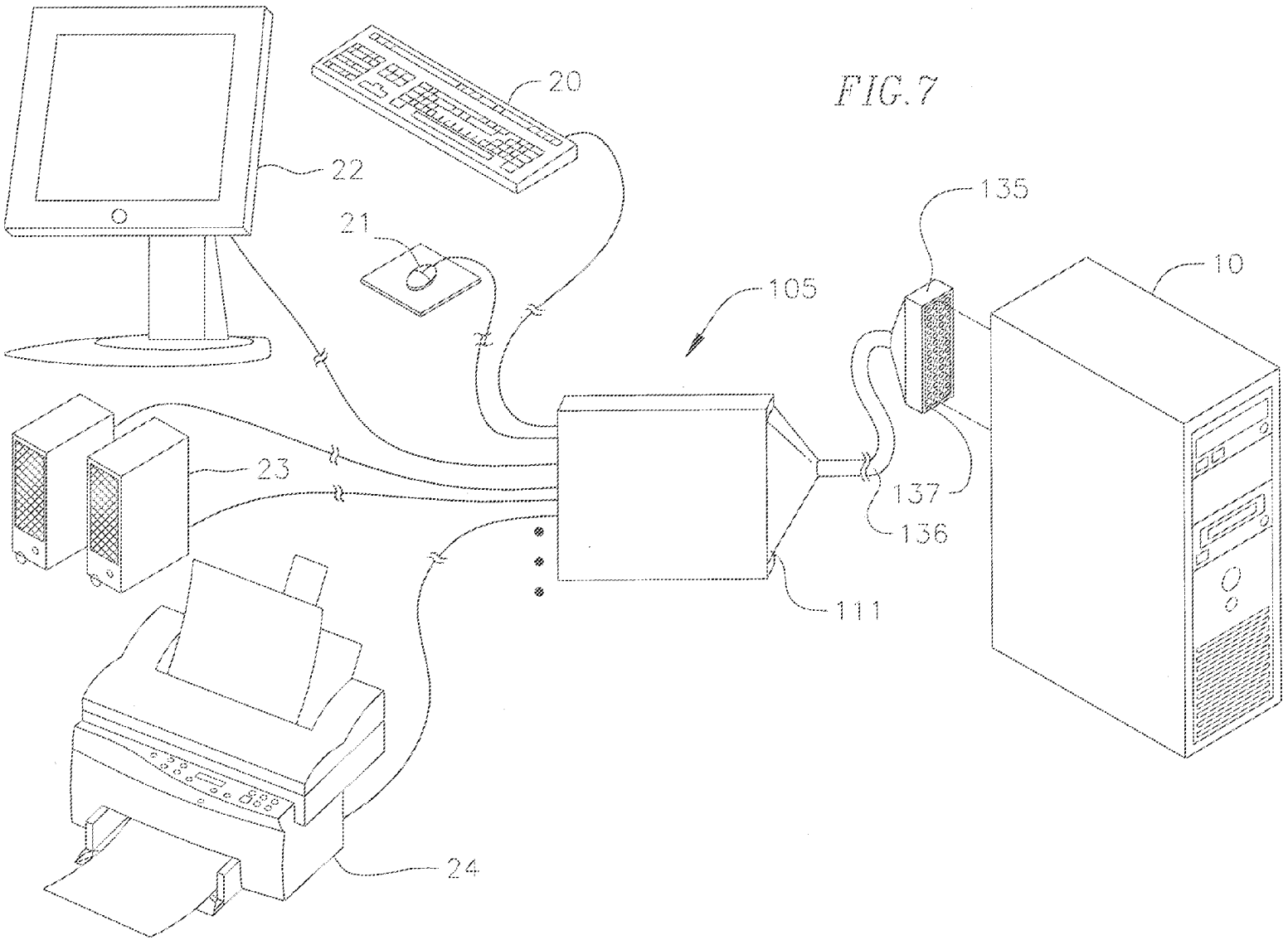
FIG. 7 is a perspective view showing a computer peripheral connector for connecting between a rear end of the quick connect/disconnect cable apparatus and a computer according to an exemplary embodiment of the present invention.

FIG. 7 is a perspective view showing a computer peripheral connector 135 for connecting between a rear end 111 of a quick connect/disconnect cable apparatus 105 and a computer 10 according to an exemplary embodiment of the present invention. As shown in FIG. 7, the quick connect/disconnect cable apparatus 105 may further include a computer peripheral connector 135 having a plurality of male leads for connecting to a female connection port of the computer 10. Alternatively, the computer peripheral connector 135 may contain a female connection port for connecting to a set of male leads of the computer 10. The quick connect/disconnect cable apparatus 105 may further include a shielded cable 136 with internal shielding between signal paths such that crosstalk between the signals transmitted through the shielded cable 136 is minimized. In such an embodiment, the computer peripheral connector 135 contains a plurality of male leads equal in number to a corresponding number of signal paths provided by the plurality of computer peripheral ports located on the quick connect/disconnect cable apparatus 105. The computer peripheral connector 135 may further include an indentation or protrusion 137 for lining up with a corresponding female connection port of the computer 10. Such an embodiment allows the computer 10 to be quickly connected/disconnected from peripheral devices 20-24 without having to determine to which port particular cables should be connected.

In such an embodiment, computer 10 includes a female connection port connected to an internal printed circuit board ("PCB") (not shown) for distributing the various cable input signals to the appropriate circuit boards, such as the sound card, video card, mother board, etc.

Figure 8:
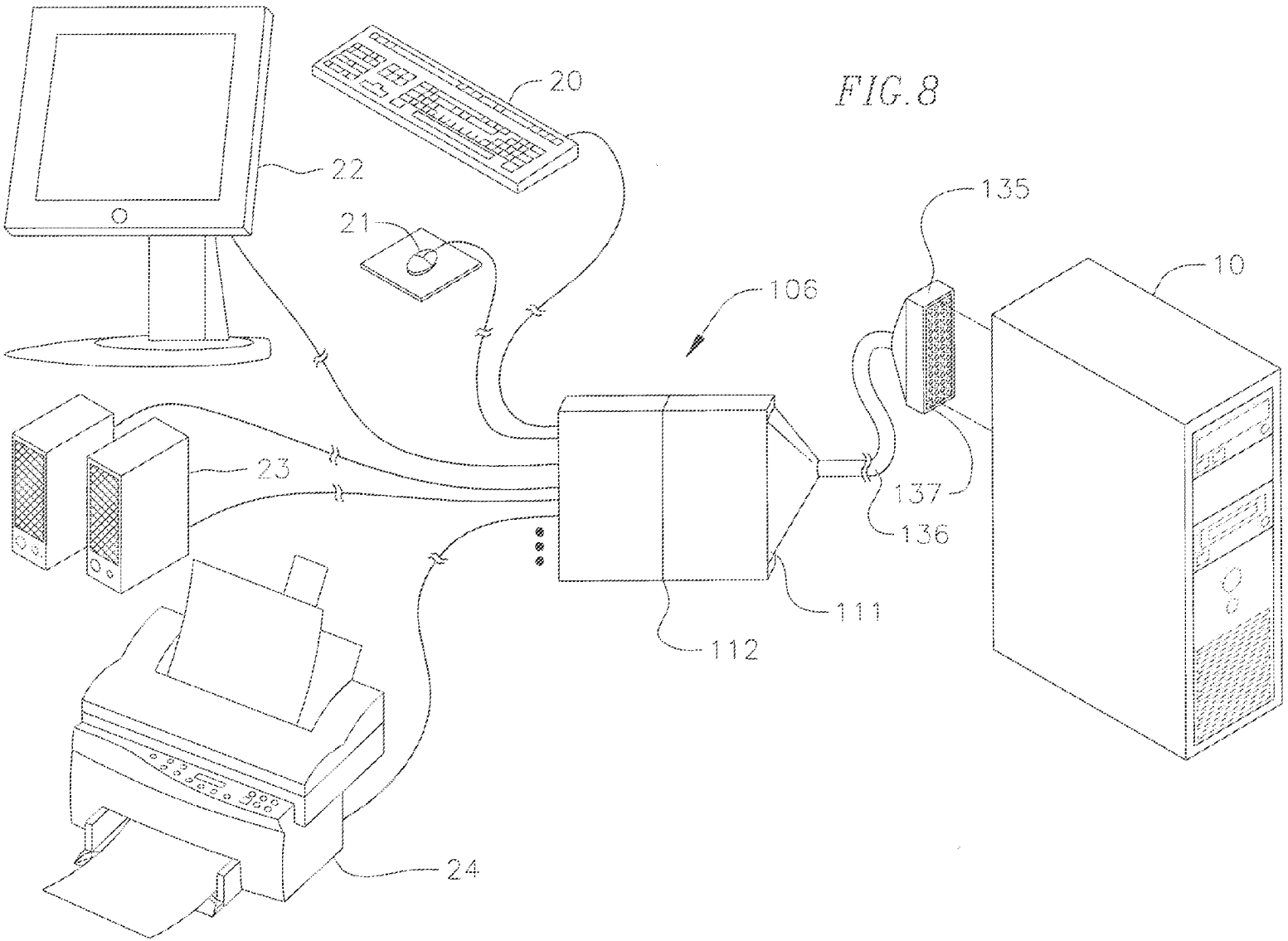
FIG. 8 is a perspective view of a quick connect/disconnect cable apparatus according to yet another exemplary embodiment of the present invention.

FIG. 8 is a perspective view of a quick connect/disconnect cable apparatus according to yet another exemplary embodiment of the present invention. The quick connect/disconnect cable apparatus 106 may further include a connect/disconnect interface 112 for allowing the user the option of disconnecting the computer from the peripherals at computer peripheral connector 135 or at connect/disconnect interface 112.

Figure 9:
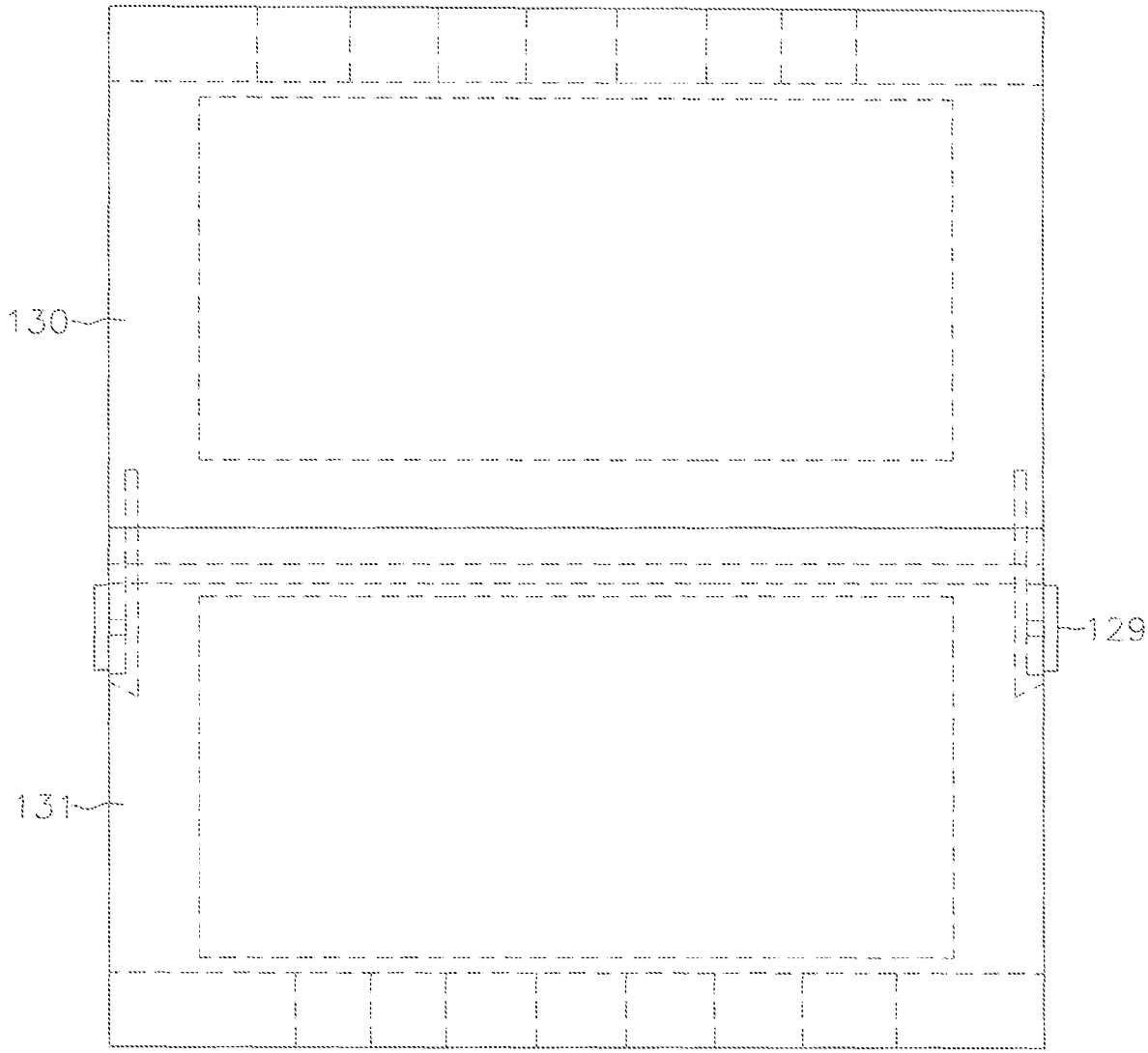
FIG. 9 is a top view of the quick connect/disconnect cable apparatus according to an exemplary embodiment of the present invention.

FIG. 9 is a top view of the quick connect/disconnect cable apparatus according to an exemplary embodiment of the present invention. As discussed in relation to FIG. 2, the quick connect/disconnect cable apparatus 100 includes means to latch a rear half 130 to a front half 131 of the quick connection/disconnect cable apparatus and a means to allow the quick connect/disconnect cable apparatus 100 to be unlatched. As depicted in FIG. 9, latching and unlatching means includes a button 129 and latch, but the latching and unlatching means may include any means known to those skilled in the art.

Figure 10:
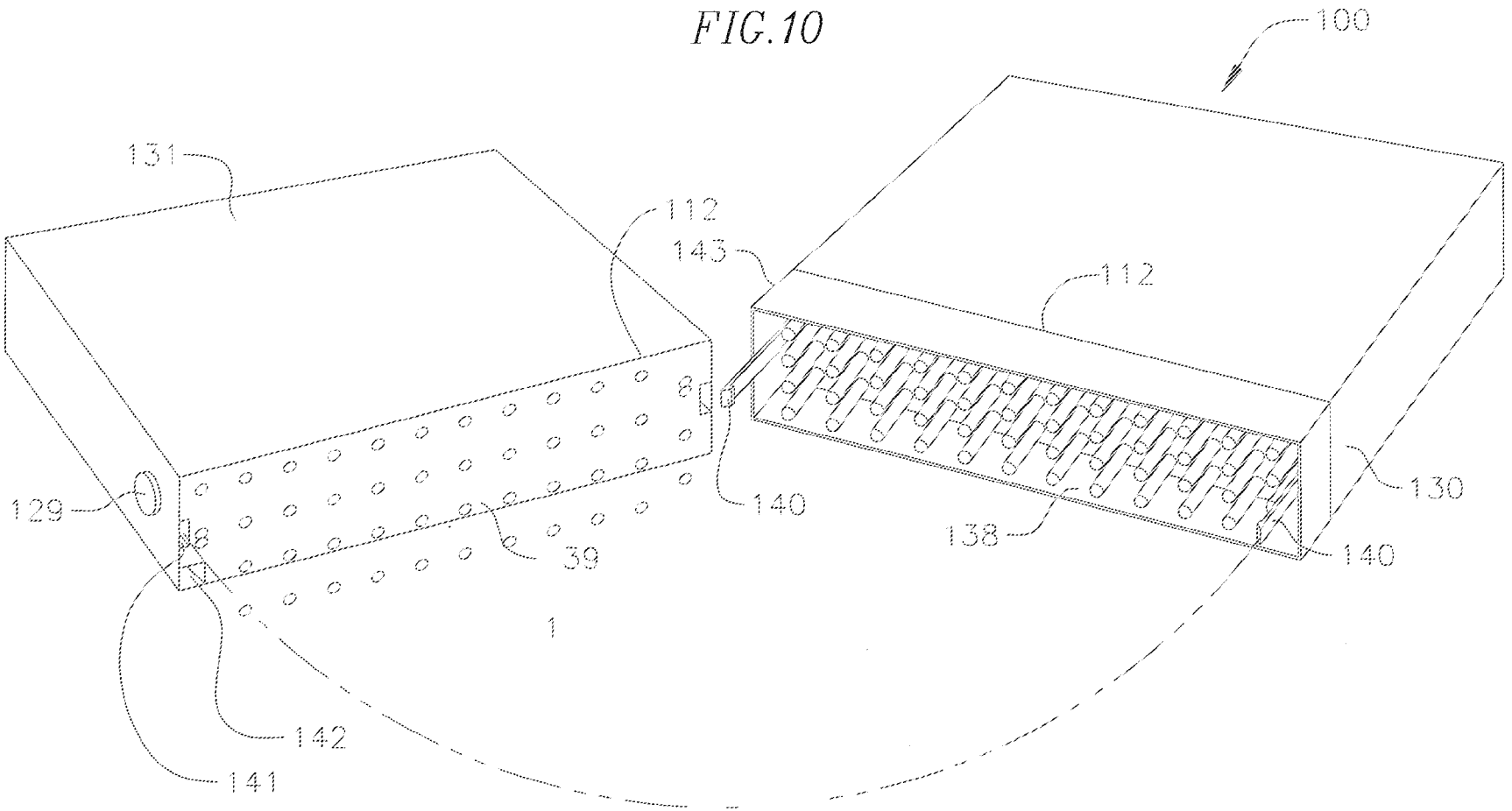
FIG. 10 is a perspective view showing connection leads and corresponding connection port of the quick connect/disconnect cable apparatus according to an exemplary embodiment of the present invention.

FIG. 10 is a perspective view showing connection leads 138 and corresponding connection port 139 of the quick connect/disconnect cable apparatus 100 according to an exemplary embodiment of the present invention. The quick connect/disconnect cable apparatus 100 includes connect/disconnect interface 112, with a front half 131 including a female port 139 and a rear half 130 including a set of male leads 138 for connecting with the female port 139. Although depicted in FIG. 10 with a female port 139 located on a front half 131 of the quick connect/disconnect cable apparatus 100, the male leads 138 may be located on the front half 131 and the female port 139 on the rear half 130. Alternatively, the front half may contain both male leads and female lead holes, and the rear half may contain corresponding mating male leads and female lead holes for allowing attachment with the first half. The quick connect/disconnect cable apparatus 100 may further include buttons 129 for unlatching protruding arms or latches 140 that slide into corresponding latch holes 141 of the quick connect/disconnect cable apparatus 100. The quick connect/disconnect cable apparatus 100 may further include an indentation or protrusion 142 for allowing a connection in proper alignment only. The quick connect/disconnect cable apparatus 100 may further include protective flange 143 having a length and width slightly greater than corresponding female port 139, thus providing protection to the male leads 138 and allowing the male leads 138 to slide into the female port 139 securely.

Figure 11:
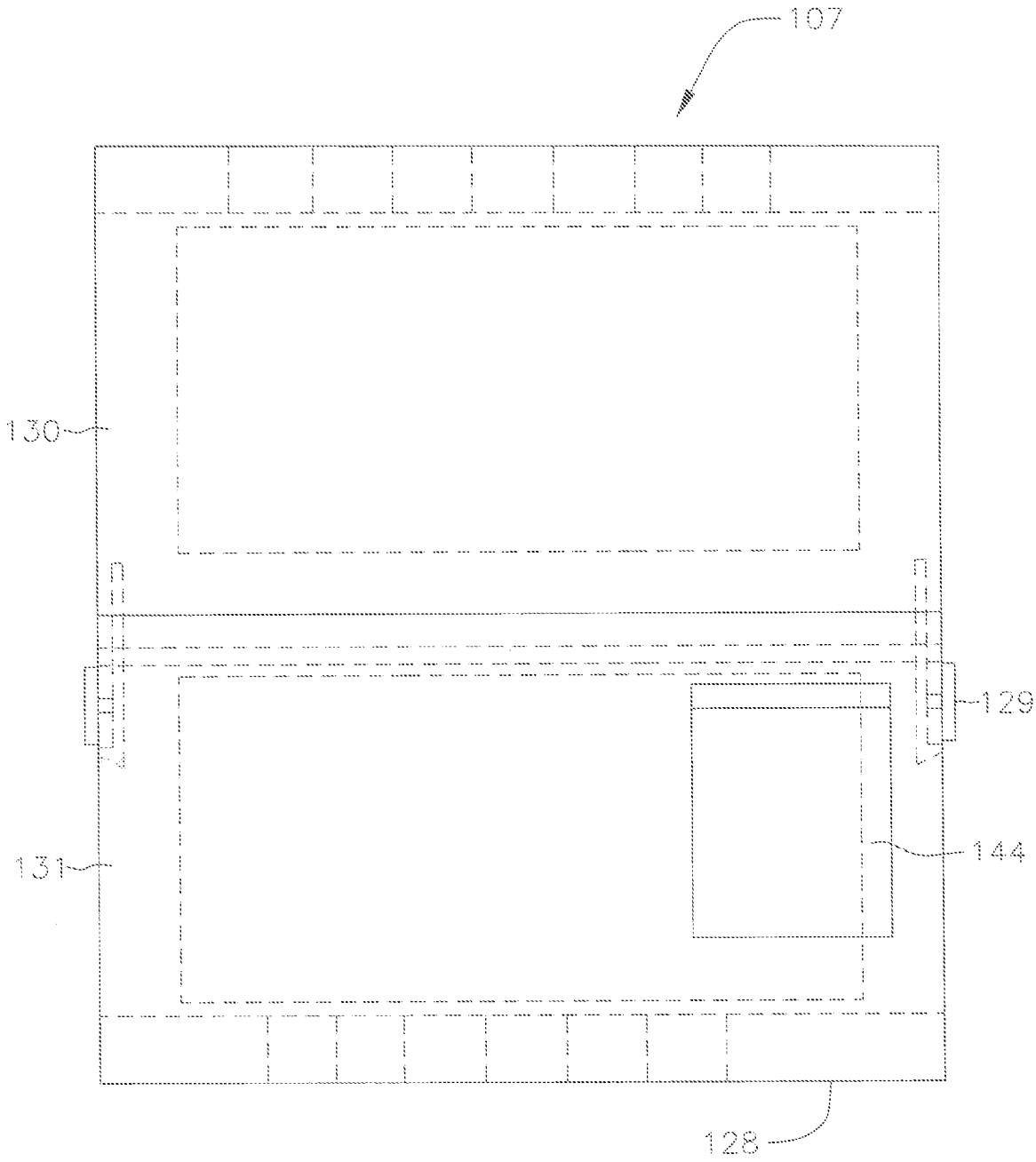
FIG. 11 is a top view of a quick connect/disconnect cable apparatus according to another exemplary embodiment of the present invention.
Figure 12:
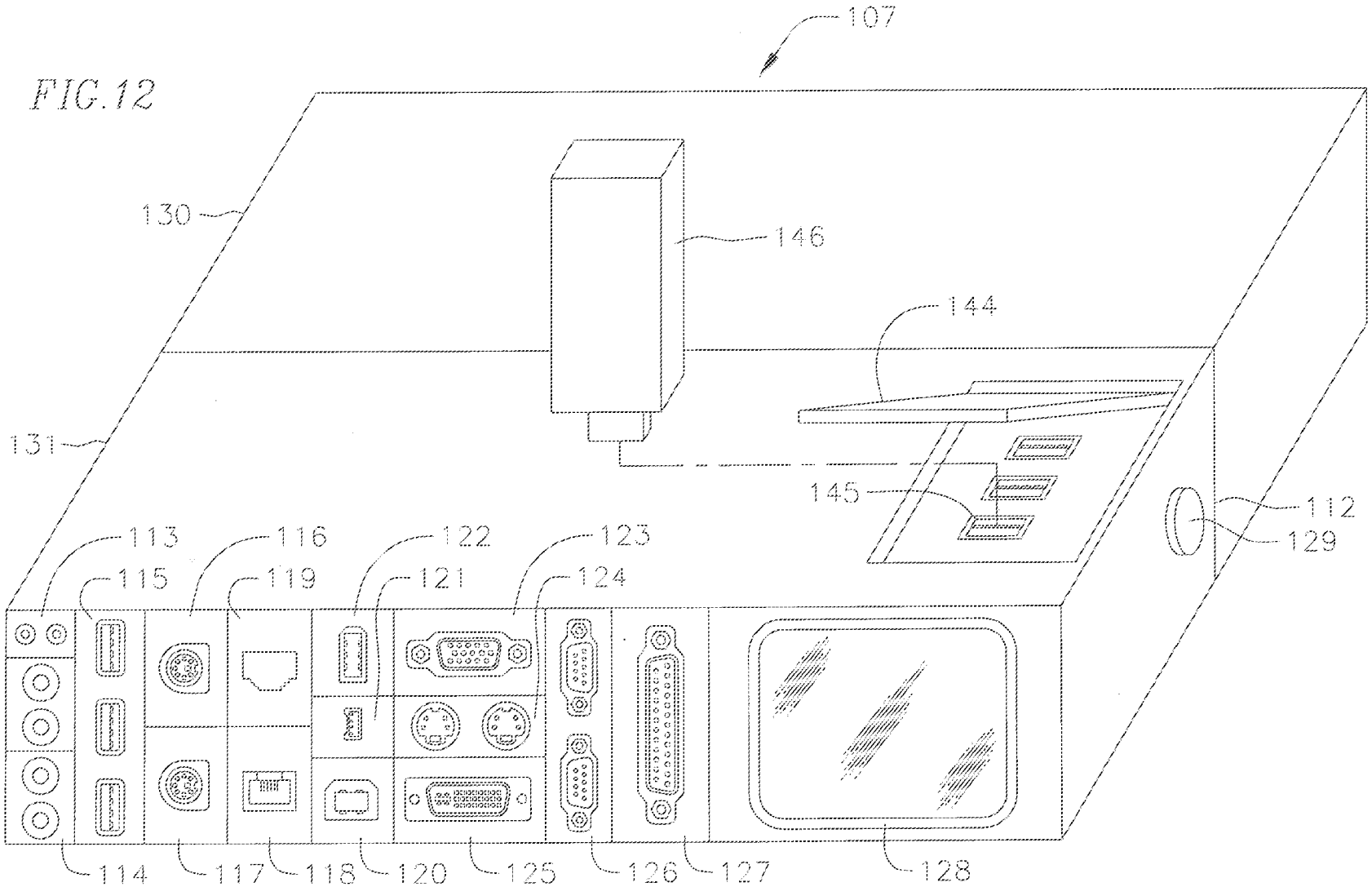
FIG. 12 is a perspective view of the quick connect/disconnect cable apparatus described with respect to FIG. 11.

FIG. 11 is a top view of a quick connect/disconnect cable apparatus 107 according to another exemplary embodiment of the present invention. FIG. 12 is a perspective view of the quick connect/disconnect cable apparatus 107 described with respect to FIG. 11. The quick connect/disconnect cable apparatus 107 may further include a lid 144 for accessing an inner portion of the front half 131 of the quick connect/disconnect cable apparatus 107 behind the receiver/transmitter window 128. The internal portion of the quick connect/disconnect cable apparatus 107 may have internal ports 145, such as USB ports, to which paired wireless receiver/transmitter devices 146 may connect. The paired wireless receiver/transmitter devices 146 may receive and send signals through the receiver/transmitter window 128.

Figure 13:
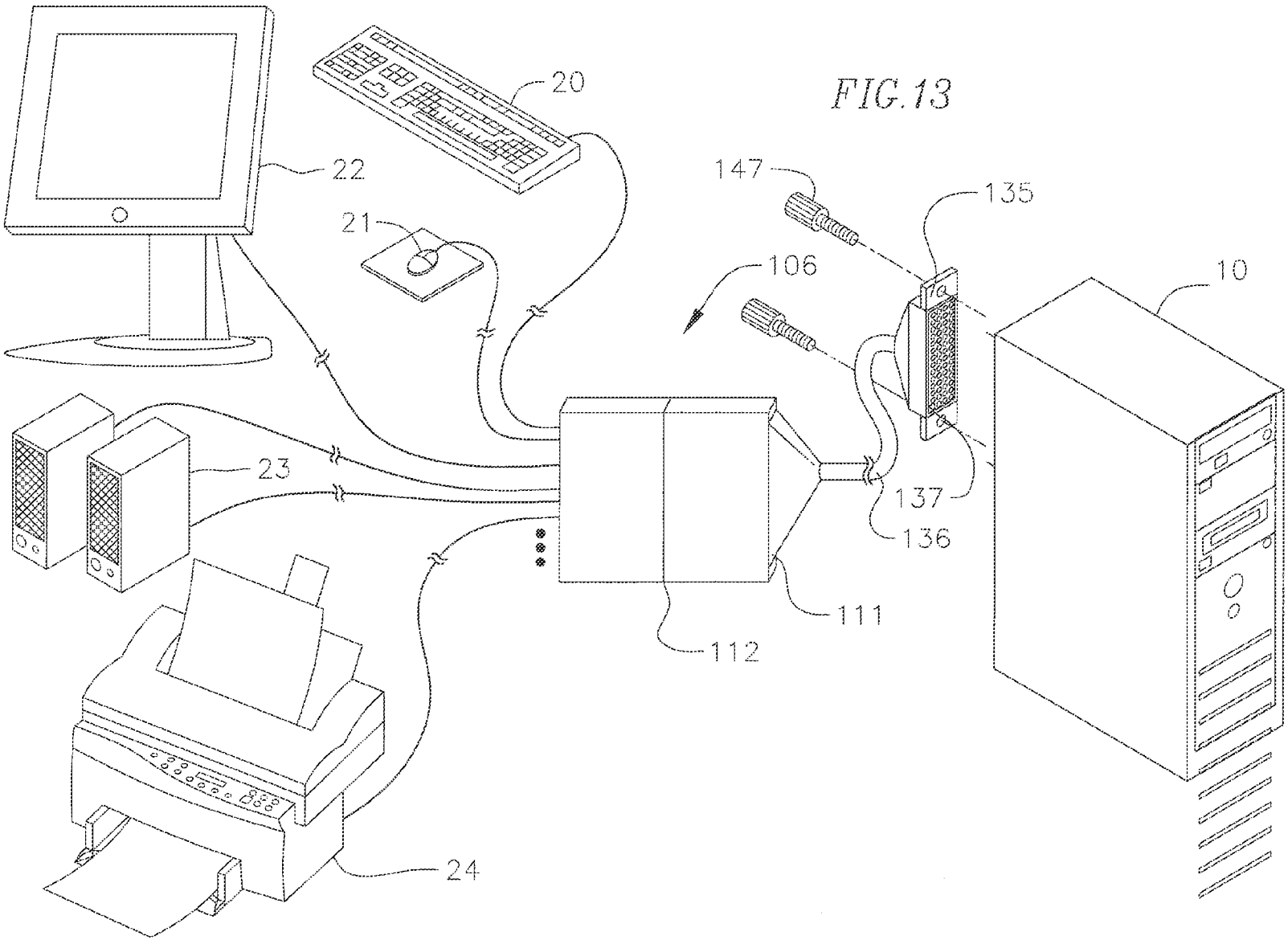
FIG. 13 is a perspective view of a quick connect/disconnect cable apparatus according to yet another exemplary embodiment of the present invention.

FIG. 13 is a perspective view of a quick connect/disconnect cable apparatus according to yet another exemplary embodiment of the present invention. The computer peripheral connector 135 may include holes for screwing the computer peripheral connector 135 to computer 10 with screws 147 in a locked position, or latches and a locking mechanism in order to securely attach the computer peripheral connector 135 to the computer 10.

Figure 14:
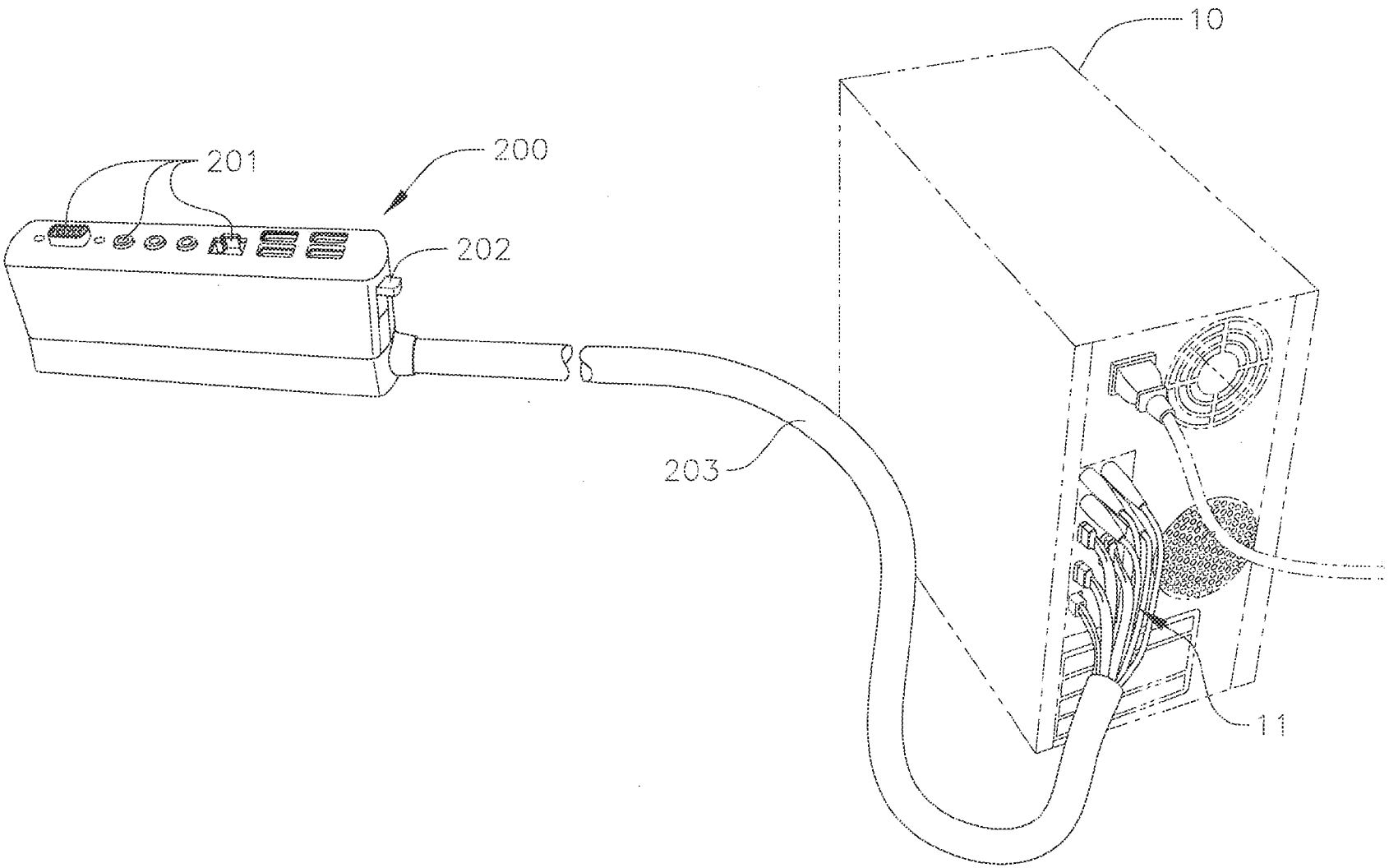
FIG. 14 is a perspective view of a quick connect/disconnect cable apparatus according to yet another exemplary embodiment of the present invention.

FIG. 14 is a perspective view of a quick connect/disconnect cable apparatus 200 according to yet another exemplary embodiment of the present invention. The quick connect/disconnect cable apparatus 200 has a plurality of ports 201 and latches 202 for allowing a top half of the quick connect/disconnect cable apparatus 200 to disconnect from a bottom half of the quick connect/disconnect cable apparatus 200. In the exemplary embodiment depicted in FIG. 14, the quick connect/disconnect cable apparatus 200 is connected to a computer 10 by port connector cables 11, which are individually exposed at an end of cable 203.

Figure 15:
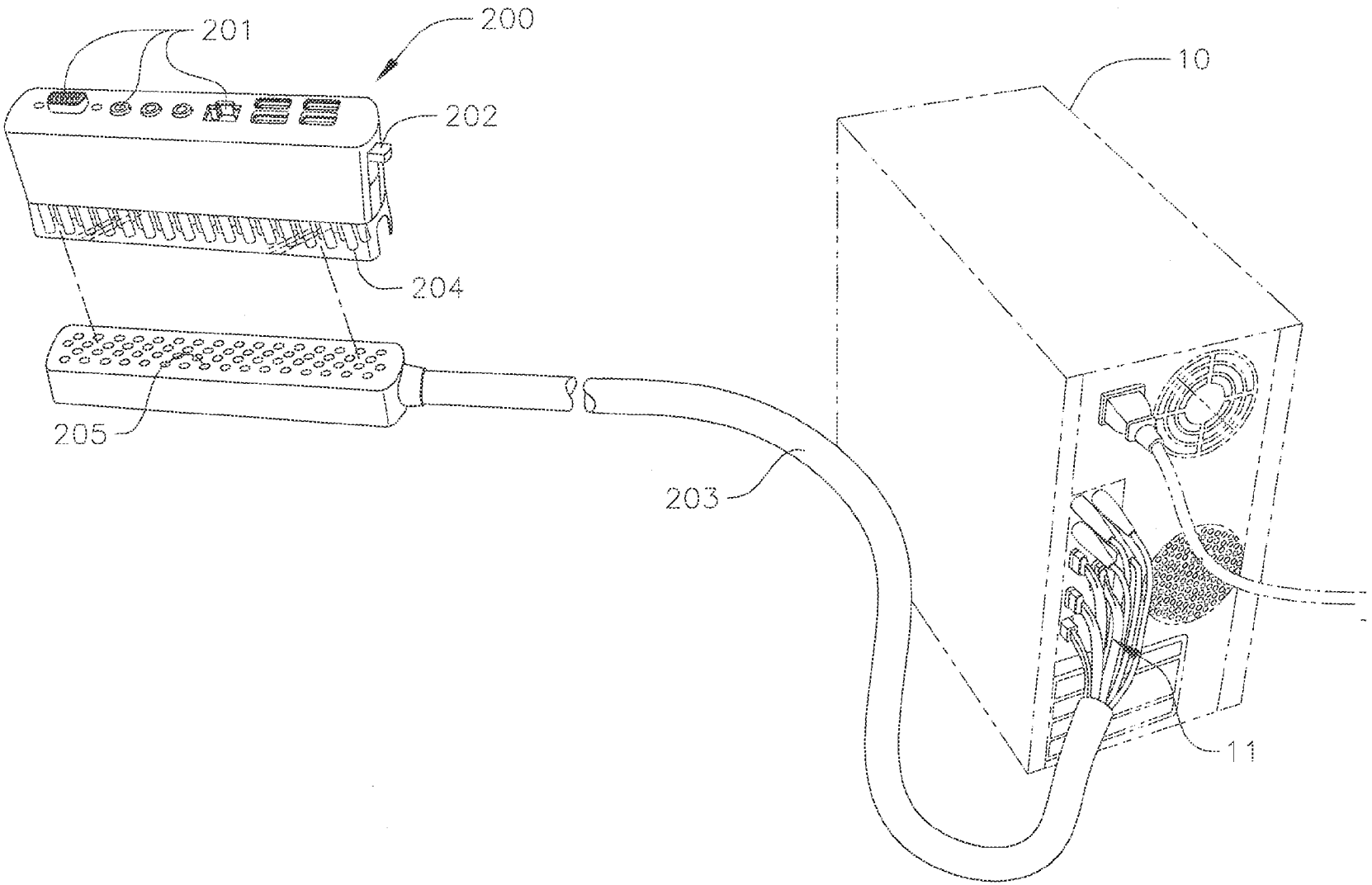
FIG. 15 is a perspective view of the quick connect/disconnect cable apparatus of FIG. 14 disconnected from the computer peripherals.

FIG. 15 is a perspective view of the quick connect/disconnect cable apparatus 200 of FIG. 14 disconnected from the computer peripherals. As depicted in FIG. 15, the quick connect/disconnect cable apparatus 200 includes a plurality of male leads 204 and female ports 205. In one exemplary embodiment, the male leads 204 are on the bottom half and the female ports 205 are on the top half of the quick connect/disconnect cable apparatus 200. In another exemplary embodiment, the male leads 204 are on the top half and the female ports 205 are on the bottom half of the quick connect/disconnect cable apparatus 200. Because male leads 204 are more likely to be damaged than female ports 205, including the female ports 205 on the bottom half of the quick connect/disconnect cable apparatus 200 will allow the computer system and the bottom half of the quick connect/disconnect cable apparatus 200 to be brought into a computer shop without worry about damaging the male leads 204 in transit.

Figure 16:
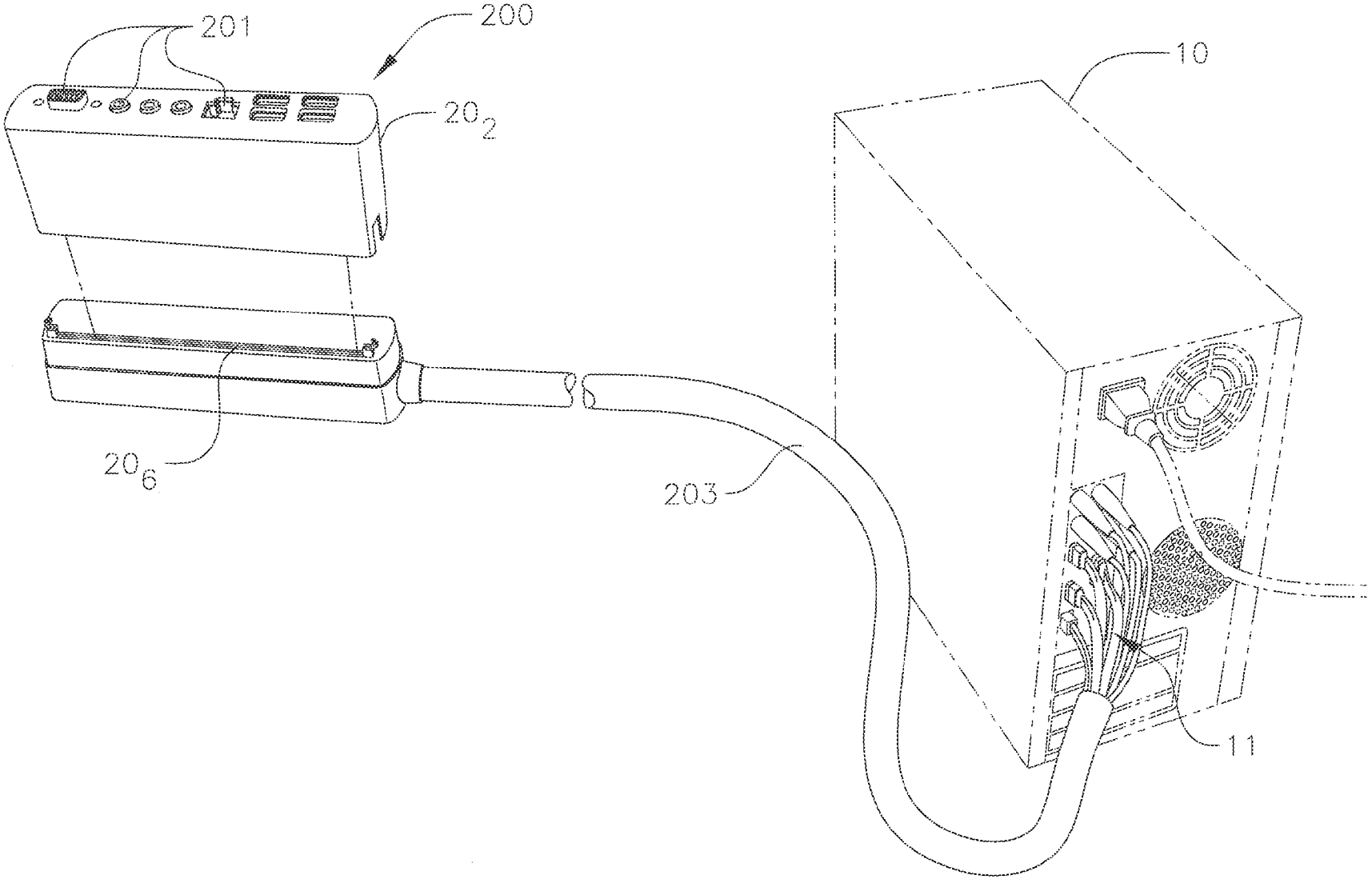
FIG. 16 is a second perspective view of a quick connect/disconnect cable apparatus of FIG. 14 disconnected from the computer peripherals according to another exemplary embodiment of the present invention.

FIG. 16 is a second perspective view of a quick connect/disconnect cable apparatus 200 of FIG. 14 disconnected from the computer peripherals according to another exemplary embodiment of the present invention. As depicted in FIG. 16, the quick connect/disconnect cable apparatus 200 may include a card slot 206 for connecting the quick connect/disconnect cable apparatus parts rather than male leads and female lead holes.

Figure 17:
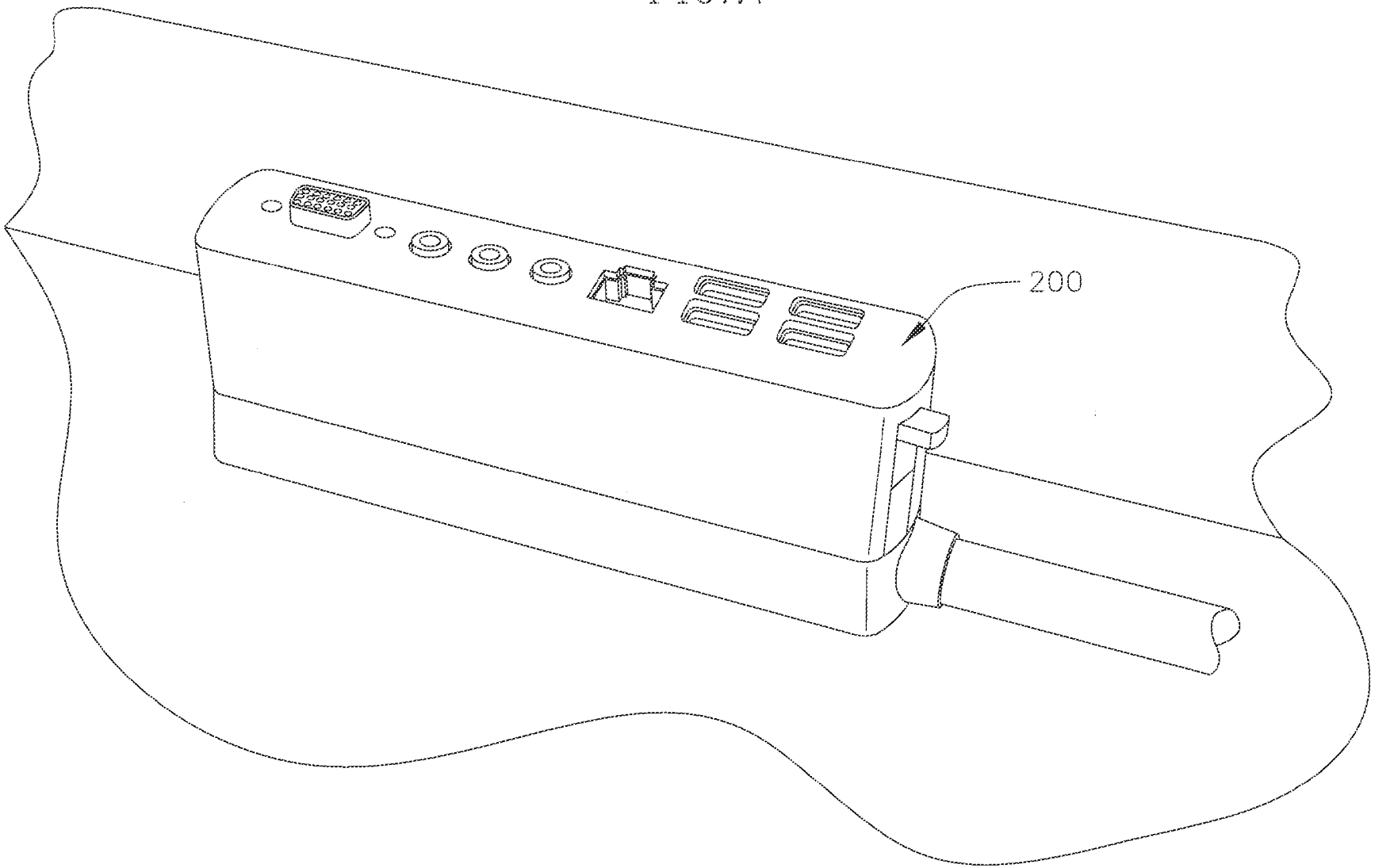
FIG. 17 is a close-up perspective view of the quick connect/disconnect cable apparatus of FIG. 14.

FIG. 17 is a close-up perspective view of the quick connect/disconnect cable apparatus 200 of FIG. 14. As depicted in FIG. 17, the quick connect/disconnect cable apparatus 200 may rest on the floor. Alternatively, the quick connect/disconnect cable apparatus 200 may be placed on top of a desk or on an underside of a table, or may be placed in various other configurations, such as connected to a wall.

Figure 18:
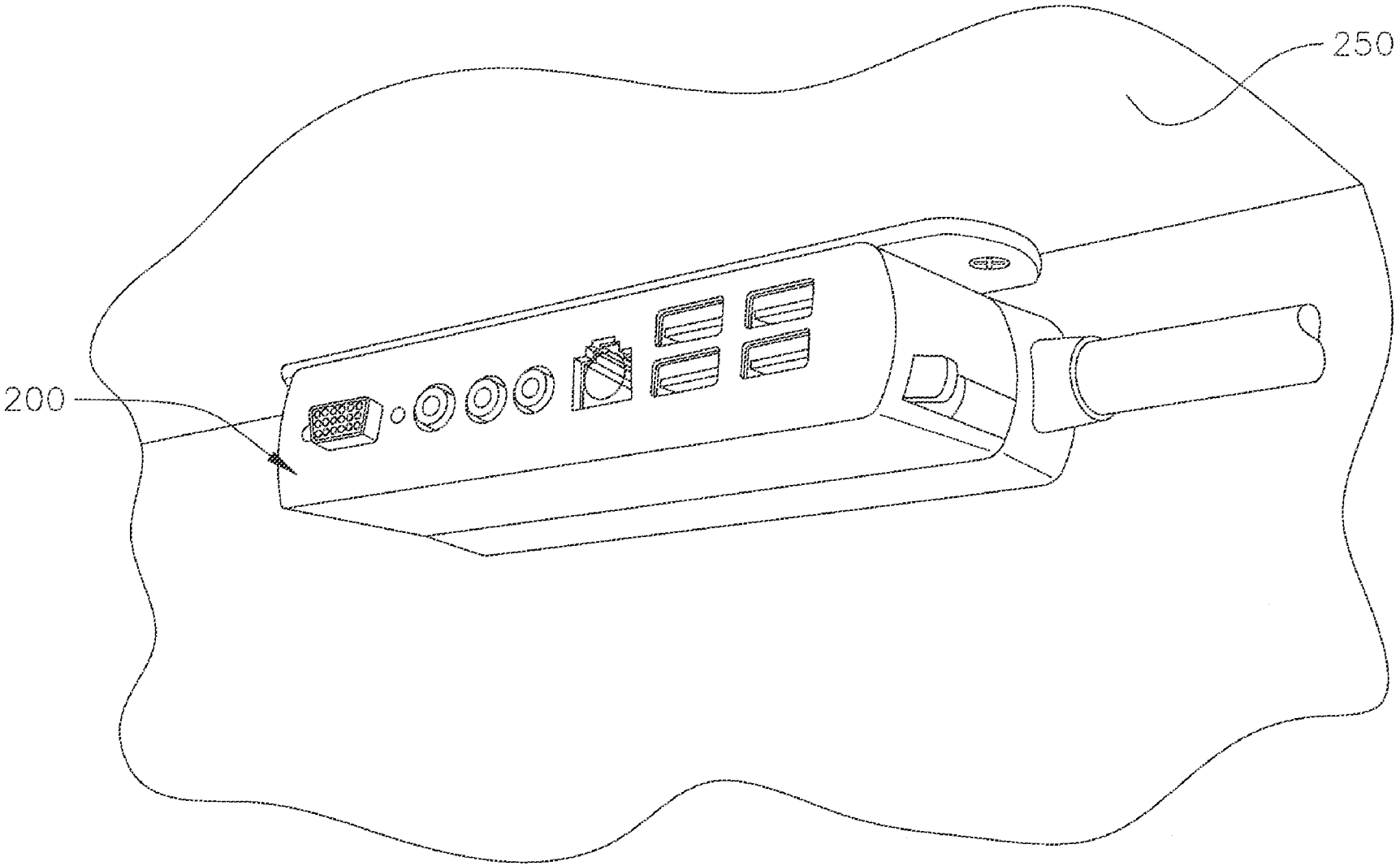
FIG. 18 is another close-up perspective view of the quick connect/disconnect cable apparatus of FIG. 14 mounted to an underside of a table.

FIG. 18 is another close-up perspective view of the quick connect/disconnect cable apparatus 200 of FIG. 14 mounted to an underside of a table 250.

Figure 19:
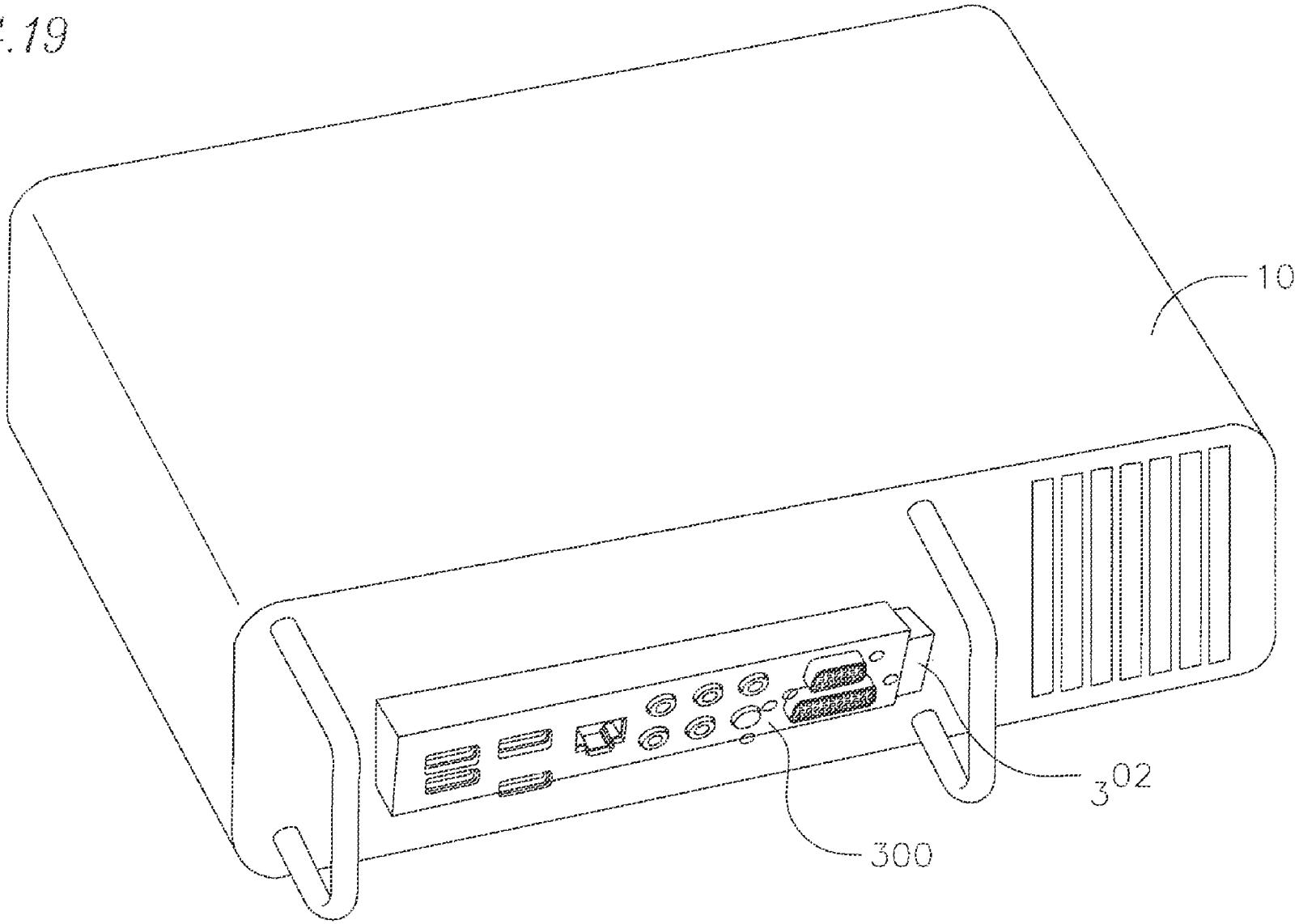
FIG. 19 is a perspective view of a quick connect/disconnect cable apparatus according to yet another exemplary embodiment of the present invention.
Figure 20:
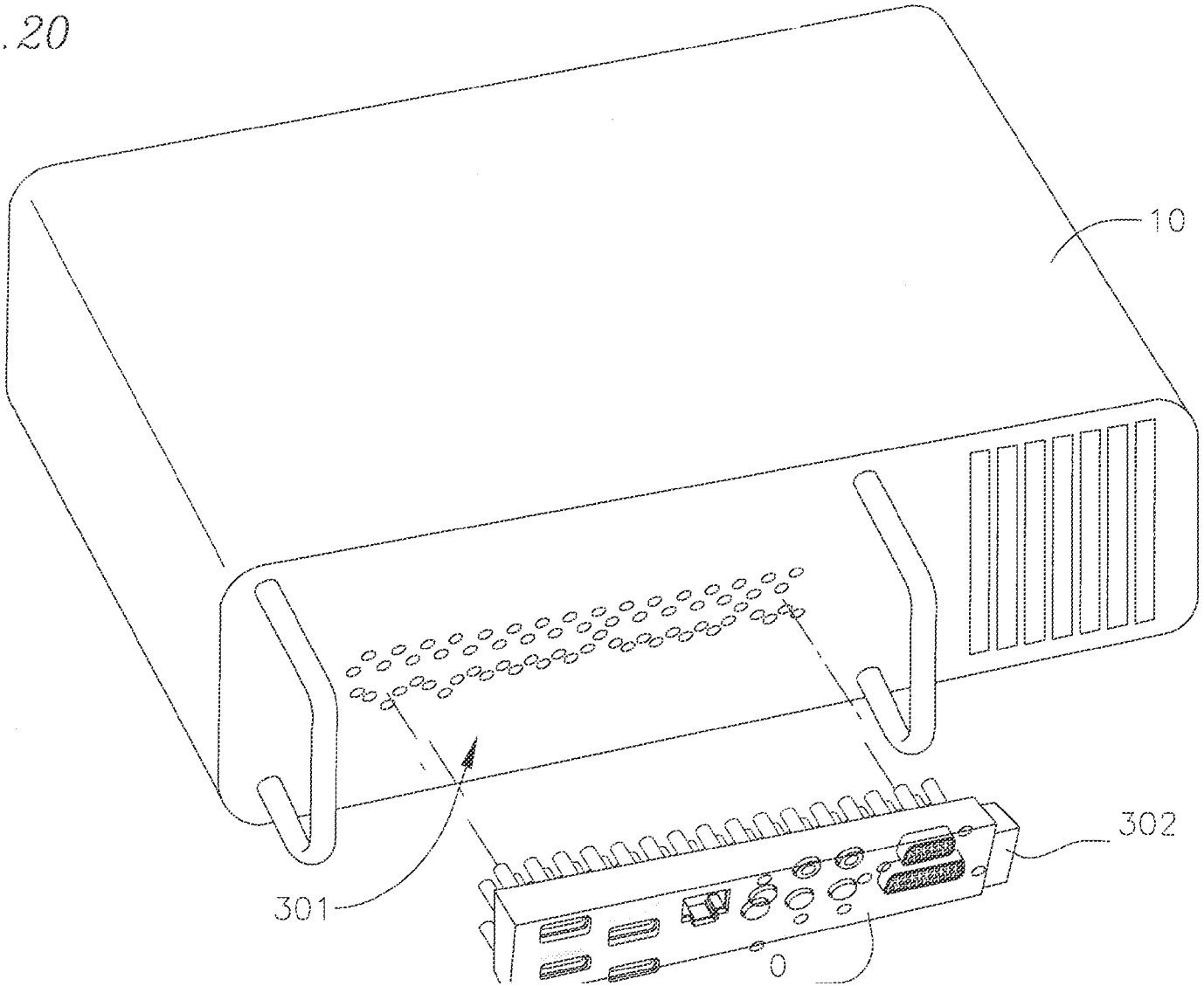
FIG. 20 is a perspective view of the computer depicted in FIG. 18 without the quick connect/disconnect cable apparatus connected.

FIG. 19 is a perspective view of a quick connect/disconnect cable apparatus 300 according to yet another exemplary embodiment of the present invention. FIG. 20 is a perspective view of the computer 10 without the quick connect/disconnect cable apparatus 300 connected. The quick connect/disconnect cable apparatus 300 connects directly to a computer 10. In such an exemplary embodiment, the quick connect/disconnect cable apparatus 300 includes peripheral ports on one side and male leads, female port holes, or both on another side for connecting with a port 301 on the computer 10. The computer 10 includes the port 301 having male leads, female port holes, or both for pairing with the quick connect/disconnect cable apparatus 300. The computer 10 may further include latches, locks, or other connection/disconnection means 302 for securing the quick connect/disconnect cable apparatus 300 to the port 301 and for allowing quick disconnection of the quick connect/disconnect cable apparatus 300 from the port 301 of the computer 10.

As described in relation to FIG. 19 and FIG. 20, the quick connect/disconnect cable apparatus 300 includes one side with a peripheral port and another side with leads, port holes, or both for connecting with a port 301 of a computer 10. Alternatively, the quick connect/disconnect cable apparatus 300 may further include the port 301 and a hardware peripheral card having the port 301. Such a hardware peripheral card would plug into the mother board of the computer 10.

Figure 21:
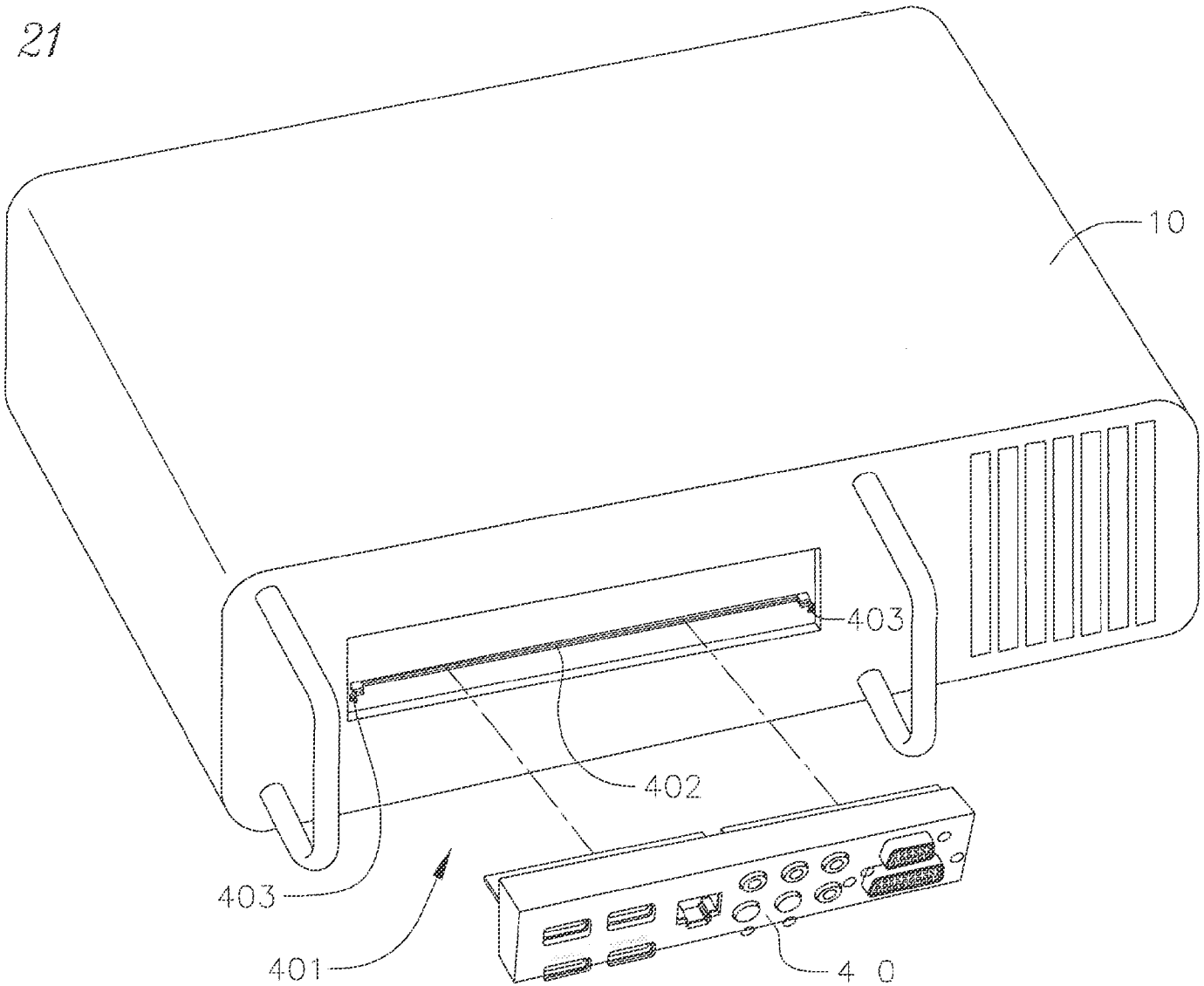
FIG. 21 is a second perspective view of the computer depicted in FIG. 18 without the quick connect/disconnect cable apparatus connected according to another exemplary embodiment of the present invention.

FIG. 21 is a second perspective view of the computer 10 depicted in FIG. 18 without the quick connect/disconnect cable apparatus 400 connected according to another exemplary embodiment of the present invention. The computer 10 has a port 401 with a card slot 402 for pairing with the quick connect/disconnect cable apparatus 400. The card connector interface is secured into the card slot 402 with card slot latches 403.

Figure 22:
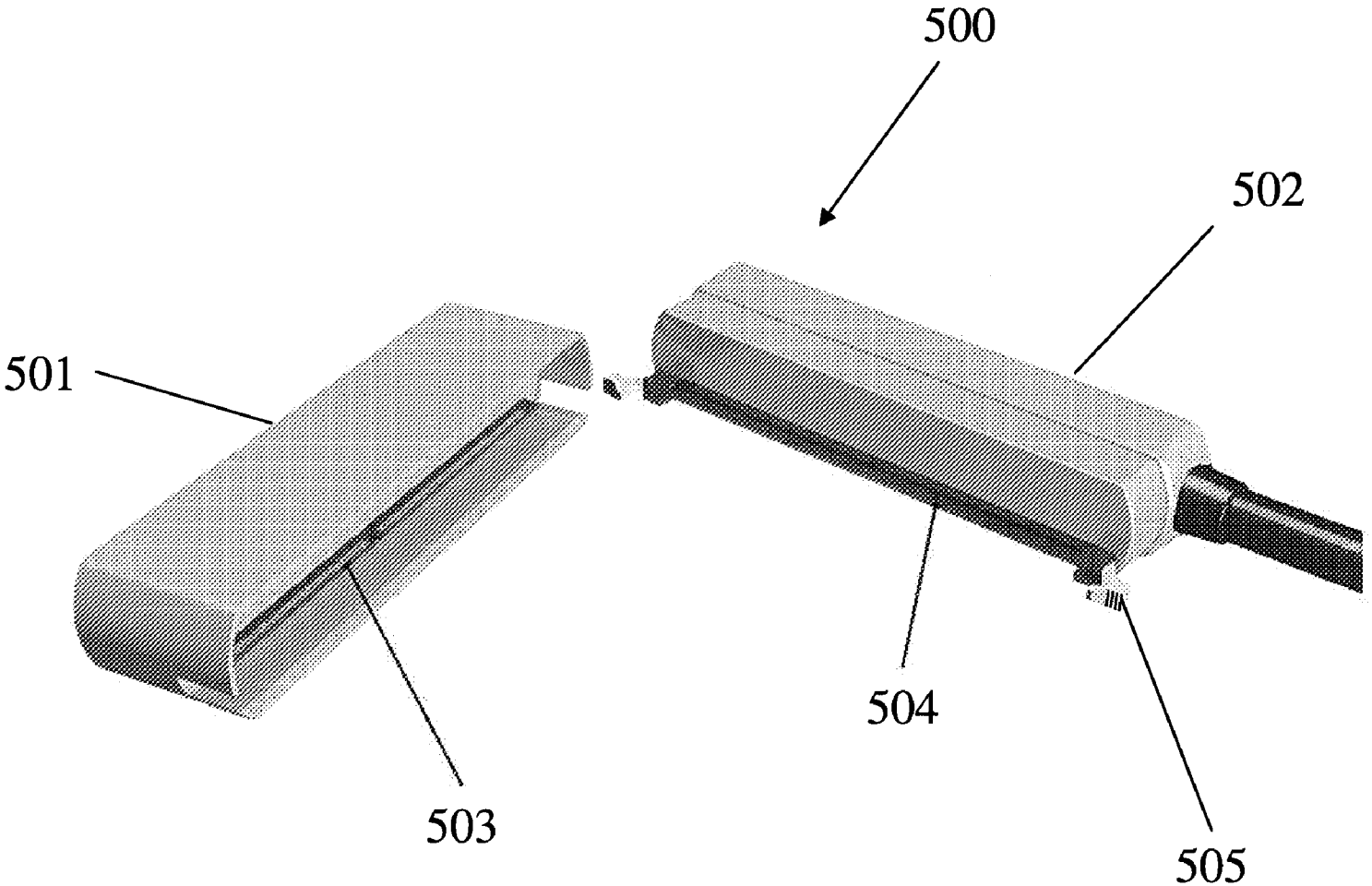
FIG. 22 is a close-up perspective view of the card connector and card connector slot of the quick connect/disconnect cable apparatus.

FIG. 22 is a close-up perspective view of the card connector and card connector slot of the quick connect/disconnect cable apparatus 500. The quick connect/disconnect cable apparatus 500 separates into first and second connecting parts 501, 502. As depicted in FIG. 22, the first connecting part 501 includes a card connector 503 and the second connecting part 502 includes a card connector slot 504 for mating with the card connector 503. The card connector 503 provides peripheral device signal lines to the card connector slot 504, which is provided to an attached computer. The second connecting part 502 may further include latches 505 for locking the card connector 503 to the card connector slot 504.

The embodiments of the quick connect/disconnect cable apparatus provide an ability to easily connect a computer to and easily disconnect a computer from peripheral devices. Such a cable apparatus with an easy connect/disconnect would be useful for computer owners who are unfamiliar with cable port types and who have to disconnect the cables to their computer in order to bring their computer in for service, to clean around or underneath the computer, or for some other reason.

While the invention has been described in terms of exemplary embodiments, it is to be understood that the words which have been used are words of description and not of limitation. As is understood by persons of ordinary skill in the art, a variety of modifications can be made without departing from the scope of the invention defined by the following claims, which should be given their fullest, fair scope.

What is claimed is:

1. A quick connect/disconnect cable apparatus comprising:

a housing having a first housing component and a second housing component, the first housing component being separable from the second housing component at an interface;

the first housing component having first connecting parts at the interface and the second housing component having corresponding mating second connecting parts at the interface;

wherein the first housing component further includes a plurality of ports located on at least one first housing component surface, the plurality of ports being adapted to allow a plurality of peripheral computer devices to connect to the plurality of ports;

wherein the second housing component further includes means for allowing a plurality of cables to connect between the second housing component and a computer, wherein the apparatus further comprises the cables in a single shielded cable and a single computer peripheral connector attached to the single shielded cable, the computer peripheral connector being adapted to connect to a peripheral computer port of the computer, wherein the second housing component has a power connection port external to the interface on a side other than the interface and connected to the means for allowing the plurality of cables to connect between the second housing component and the computer.

2. The quick connect/disconnect cable apparatus as claimed in claim 1, wherein the first connecting parts include at least one of male metal leads or female metal lead holes, and the second connecting parts include corresponding mating male metal leads and/or female metal lead holes, with the male metal leads being adapted to insert into the female metal lead holes.

3. The quick connect/disconnect cable apparatus as claimed in claim 1, wherein the first connecting parts include at least one of a card connector or a card connector slot, and the second connecting parts include a corresponding mating card connector or card connector slot, with the card connector adapted to insert into the card connector slot.

4. The quick connect/disconnect cable apparatus as claimed in claim 1, wherein the plurality of ports include at least one of a mini audio jack, a large audio jack, a type A Universal Serial Bus port, a PS/2 keyboard port, a Registered Jack-11, an Ethernet port, a type B Universal Serial Bus port, a 4-pin FireWire, a 6-pin FireWire, a VGA connector port, an S-Video port, a Digital Video Interface port, a serial port, or a parallel port.

5. The quick connect/disconnect cable apparatus as claimed in claim 1, wherein the first housing component or the second housing component includes a wireless receiver and transmitter for communicating with at least one wireless periphery device.

6. The quick connect/disconnect cable apparatus as claimed in claim 1, wherein the first housing component further includes a receiver/transmitter window.

7. The quick connect/disconnect cable apparatus as claimed in claim 6, wherein the first housing component further includes internal housing ports located within the housing adjacent the receiver/transmitter window.

8. The quick connect/disconnect cable apparatus as claimed in claim 1, wherein the first housing component or second housing component includes a latching means for securing the first housing component and the second housing component together.

9. The quick connect/disconnect cable apparatus as claimed in claim 1, wherein the first housing component includes a power connection port.

10. The quick connect/disconnect cable apparatus as claimed in claim 1, wherein the second housing component is adapted to be mounted to a table, a floor, or a wall.

11. The quick connect/disconnect cable apparatus as claimed in claim 1, wherein the computer peripheral connector includes a plurality of male leads, female port holes, or both, for connecting to the peripheral computer port, and further includes an indentation or protrusion for aiding in aligning the computer peripheral connector for attachment to the peripheral computer port, the peripheral computer port having a corresponding indentation or protrusion.

12. The quick connect/disconnect cable apparatus as claimed in claim 11, wherein the computer peripheral connector is securable to the peripheral computer port.

13. The quick connect/disconnect cable apparatus as claimed in claim 1, wherein the computer peripheral connector includes a card connector or a card connector slot for connecting to the peripheral computer port.

14. A quick connect/disconnect cable apparatus and computer system assembly comprising:

a housing having a first housing component and a second housing component, the first housing component being separable from the second housing component at an interface;

the first housing component having first connecting parts on a first housing component surface of the interface, and the second housing component having corresponding mating second connecting parts on a second housing component surface of the interface;

wherein the first housing component further includes a plurality of ports located on at least one first housing component surface, the plurality of ports being adapted to allow a plurality of peripheral computer devices to connect to the plurality of ports, the plurality of ports providing all periphery port connections for the second housing component;

wherein the second housing component is a computer system, the computer system having a peripheral computer port for allowing the first housing component to attach, the peripheral computer port being on said second housing component surface, the computer system having no other peripheral ports other than said peripheral computer port.

15. The assembly as claimed in claim 14, wherein the first connecting parts include at least one of male metal leads or female metal lead holes, and the second connecting parts include corresponding mating male metal leads and/or female metal lead holes, with the male metal leads being adapted to insert into the female metal lead holes.

16. The assembly as claimed in claim 14, wherein the first connecting parts include at least one of a card connector or a card connector slot, and the second connecting parts include a corresponding mating card connector or card connector slot, with the card connector adapted to insert into the card connector slot.

17. The assembly as claimed in claim 14, wherein the plurality of ports include at least one of a mini audio jack, a large audio jack, a type A Universal Serial Bus port, a PS/2 keyboard port, a Registered Jack-11, an Ethernet port, a type B Universal Serial Bus port, a 4-pin FireWire, a 6-pin FireWire, a VGA connector port, an S-Video port, a Digital Video Interface port, a serial port, or a parallel port.

18. The assembly as claimed in claim 14, wherein the first housing component includes a wireless receiver and transmitter for communicating with at least one wireless periphery device.

19. The assembly as claimed in claim 14, wherein the first housing component is securable to the peripheral computer port.

20. The apparatus of claim 14, wherein the first housing component or the second housing component includes a push button release for allowing the first housing component to be detached from the peripheral computer port.

21. A peripheral port connector device comprising:

a body;

a plurality of ports on a first side of the body for providing all periphery port connections for a computer having no other periphery port connections; and a computer port connector on a second side of the body, the computer port connector having a plurality of male leads and/or female lead holes, or a card connector and/or card connector slot, wherein the computer port connector is adapted to connect directly to a peripheral computer port of the computer, the peripheral computer port having a corresponding plurality of male leads and/or female port holes or a corresponding card connector and/or card connector slot for allowing the computer port connector to attach.

22. The peripheral port connector device as claimed in claim 21, wherein the peripheral computer port provides data connections for all peripheral devices to connect to the computer.

23. The peripheral port connector device as claimed in claim 21, wherein the plurality of ports include at least one of a mini audio jack, a large audio jack, a type A Universal Serial Bus port, a PS/2 keyboard port, a Registered Jack-11, an Ethernet port, a type B Universal Serial Bus port, a 4-pin FireWire, a 6-pin FireWire, a VGA connector port, an S-Video port, a Digital Video Interface port, a serial port, or a parallel port.

24. The peripheral port connector device as claimed in claim 21, wherein the body includes a wireless receiver and transmitter for communicating with at least one wireless periphery device.

25. The peripheral port connector device as claimed in claim 21, wherein the body is securable to the peripheral computer port.

26. The peripheral port connector device of claim 21, wherein the body includes a push button release for allowing the computer port connector to be detached from the peripheral computer port.

27. An apparatus comprising:

a housing having a first housing component and a second housing component, the first housing component being separable from the second housing component at an interface;

the first housing component having first connecting parts at the interface and the second housing component having corresponding mating second connecting parts at the interface;

wherein the first housing component further includes a plurality of ports located on at least one first housing component surface, the plurality of ports being adapted to allow a plurality of peripheral computer devices to connect to the plurality of ports;

wherein the second housing component further includes means for allowing one or more cables to connect between the second housing component and a computer, wherein the second housing component includes a second housing component port external to the interface on a side other than the interface, wherein the second housing component port is connected only to said means for allowing the one or more cables to connect between the second housing component and the computer.

28. The apparatus as claimed in claim 27, wherein the second housing component port is a power connection port.

* * * * *